US007197256B2

(12) United States Patent
Nishizaki

(10) Patent No.: US 7,197,256 B2
(45) Date of Patent: Mar. 27, 2007

(54) IMAGE FORMING APPARATUS WITH TRANSFER BELT SPEED CONTROL

(75) Inventor: Shingo Nishizaki, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 287 days.

(21) Appl. No.: 10/872,091

(22) Filed: Jun. 18, 2004

(65) Prior Publication Data

US 2005/0008406 A1 Jan. 13, 2005

(30) Foreign Application Priority Data

Jun. 24, 2003 (JP) ..... 2003-178988

(51) Int. Cl.
*G03G 15/16* (2006.01)

(52) U.S. Cl. ..... 399/66; 399/396

(58) Field of Classification Search ..... 399/40, 399/49, 66, 298, 299, 301, 302, 303, 308, 399/396

See application file for complete search history.

(56) References Cited

U.S. PATENT DOCUMENTS

| | | | | |
|---|---|---|---|---|
| 5,452,073 | A * | 9/1995 | Kataoka | 399/299 |
| 6,198,897 | B1 * | 3/2001 | Ream | 399/301 |
| 6,324,355 | B1 * | 11/2001 | Matsui et al. | 399/38 |
| 6,330,404 | B1 * | 12/2001 | Munenaka et al. | 399/51 |
| 6,363,228 | B1 * | 3/2002 | Ream | 399/66 |
| 6,661,981 | B2 * | 12/2003 | Boothe et al. | 399/44 |
| 2004/0057737 | A1 | 3/2004 | Yokono | |

FOREIGN PATENT DOCUMENTS

| | | | |
|---|---|---|---|
| JP | 06-127037 | | 5/1994 |
| JP | 11-174932 | | 7/1999 |
| JP | 2001-051479 | | 2/2001 |
| JP | 2001337504 | A * | 12/2001 |
| JP | 2003173067 | A * | 6/2003 |

OTHER PUBLICATIONS

U.S. Appl. No. 10/659,176 of Shingo Nishizaki filed Sep. 10, 2003.

* cited by examiner

*Primary Examiner*—Robert Beatty
(74) *Attorney, Agent, or Firm*—Cooper & Dunham LLP

(57) ABSTRACT

An image forming apparatus is disclosed that is capable of automatically acquiring thickness variation data of a transfer belt newly installed in the image forming apparatus without manual operation of setting the thickness variation data, and capable of controlling the moving speed of the newly installed transfer belt to be constant based on the acquired data so as to output images of high quality constantly. The transfer belt includes a belt information mark recorded with information used for creating rotational speed correction data, and the rotational speed control unit includes a storage unit configured to store the rotational speed correction data. A rotational speed control unit is provided that includes a belt information reading unit for reading the belt information mark to obtain the belt information, and a correction data updating unit for updating and storing the rotational speed correction data based on the obtained belt information.

14 Claims, 17 Drawing Sheets

IMAGE FORMING APPARATUS WITH TRANSFER BELT SPEED CONTROL

BACKGROUND OF THE INVENTION

1. Field of the Invention

The present invention relates to an image forming apparatus able to be used in a printer, a copier, or a combination of them, and more particularly, to an image forming apparatus in which a target color image is formed by transferring and superposing monochromatic color images on photo conductors to a transfer belt sequentially, and a moving speed of the transfer belt is controlled to be constant so as to suppress color deviation.

2. Description of the Related Art

Among electrophotographic image forming apparatuses, market demand for color image forming apparatuses, such as color printers, color copiers, is rapidly increasing, and especially recently, users are requiring a speed of color image formation comparable to that of monochromatic image formation.

In order to meet this demand, a tandem engine configuration is more and more adopted in the color image forming apparatus. In a color image forming apparatus of the tandem engine configuration, a set of a photoconductor, a developing device, a writing optical system, and other devices, is provided for each color component of a color image to be formed by the color image forming apparatus (referred to as "target color image" below), and monochromatic toner images corresponding to the respective color components of the target color image are formed on the respective photoconductors, and these monochromatic toner images of different colors are then sequentially transferred to a recording sheet, thereby resulting in a full color image on the recording sheet.

There are two types of the color image forming apparatuses of the tandem engine configuration; one involves "direct transfer", and the other one involves "indirect transfer".

FIG. 1 is a schematic view showing a configuration of a direct-transfer image forming apparatus 10*a*.

In the direct-transfer image forming apparatus 10*a*, a transfer belt 151, which is a flexible belt, is wound on a driving roller 152 (driven by a not-illustrated motor) and a driven roller 153. The upper part of the transfer belt 151 is placed between photo conductor drums 102C, 102M, 102Y, 102K for forming cyan (C), magenta (M), yellow (Y), and black (K) monochromatic images, respectively, and the correspondingly arranged transfer rollers 104C, 104M, 104Y, 104K, and is driven to move in the left direction in FIG. 1.

The surface of each of the photo conductor drums 102C, 102M, 102Y, 102K is uniformly charged by a not-illustrated charging device. Optical writing units 101C, 101M, 101Y, 101K, which are controlled by a controller 110, emit modulated laser beams according to the cyan, magenta, yellow, and black monochromatic image data onto the charged surfaces of the photo conductor drums 102C, 102M, 102Y, 102K. Thereby, the charged surfaces of the photo conductor drums 102C, 102M, 102Y, 102K are neutralized, and latent images are formed on the surfaces of the photo conductor drums 102C, 102M, 102Y, 102K.

When the thus formed latent images move between the corresponding photo conductor drums 102C, 102M, 102Y, 102K and the developing devices 103C, 103M, 103Y, 103K, cyan, magenta, yellow, and black monochromatic toners stored in the respective developing devices 103C, 103M, 103Y, 103K are added onto the respective latent images by the developing devices 103C, 103M, 103Y, 103K, and thereby, the latent images are converted into visible toner images.

On the other hand, a recording sheet is conveyed by a pair of conveyance rollers 106 and is closely attached onto the upper part of the transfer belt 151 to move together with the transfer belt 151. When the recording sheet moves through pairs of the photo conductor drums 102C, 102M, 102Y, 102K and the transfer rollers 104C, 104M, 104Y, 104K, sequentially, the cyan, magenta, yellow, and black monochromatic toner images on the photo conductor drums 102C, 102M, 102Y, 102K are sequentially and directly transferred onto the recording sheet, and are superposed on the recording sheet. As a result, a superposed full color image is formed on the surface of the recording sheet.

The recording sheet carrying the superposed full color image is further conveyed into a fusing unit 107. When the recording sheet passes through the fusing unit 107, the recording sheet is heated and pressed, and thereby the superposed full color image is fused and fixed on the recording sheet.

FIG. 2 is a schematic view showing a configuration of an indirect-transfer image forming apparatus 10*b*. In FIG. 2, same reference numerals are used for the same elements as those in FIG. 1.

In the indirect-transfer image forming apparatus 10*b*, a transfer belt 151 is wound on a driving roller 152, which is driven by a not-illustrated motor, and a driven roller 153. The lower part of the transfer belt 151 is disposed between photo conductor drums 102C, 102M, 102Y, 102K for forming cyan (C), magenta (M), yellow (Y), and black (K) monochromatic images, respectively, and the correspondingly arranged transfer rollers 104C, 104M, 104Y, 104K, and is driven to move in the left direction in FIG. 2.

The surface of each of the photo conductor drums 102C, 102M, 102Y, 102K is uniformly charged by a not-illustrated charging device. Optical writing units 101C, 101M, 101Y, 101K, which are controlled by a controller 110, emit modulated laser beams according to the cyan, magenta, yellow, and black monochromatic image data onto the charged surfaces of the photo conductor drums 102C, 102M, 102Y, 102K. Thereby, the charged surfaces of the photo conductor drums 102C, 102M, 102Y, 102K are neutralized, and latent images are formed on the surfaces of the photo conductor drums 102C, 102M, 102Y, 102K.

When the thus formed latent images move between the corresponding photo conductor drums 102C, 102M, 102Y, 102K and corresponding developing devices 103C, 103M, 103Y, 103K, cyan, magenta, yellow, and black monochromatic toners, which are stored in the respective developing devices 103C, 103M, 103Y, 103K, are added onto the respective latent images by the developing devices 103C, 103M, 103Y, 103K, and thereby, the monochromatic latent images are converted into visible monochromatic toner images.

The cyan, magenta, yellow, and black monochromatic toner images on the photo conductor drums 102C, 102M, 102Y, 102K are then sequentially transferred onto a portion of the transfer belt 151 when the portion sequentially passes through each pair of the photo conductor drums 102C, 102M, 102Y, 102K and the transfer rollers 104C, 104M, 104Y, 104K, and then superposed on the portion of the transfer belt 151, resulting in a full color toner image on the transfer belt 151. The full color toner image is conveyed while the transfer belt 151 is moving in the left direction.

On the other hand, a recording sheet is conveyed at an appropriate timing by a pair of conveyance rollers 108 to the position between the driving roller 152 and a secondary transfer roller 160. The recording sheet is moved between the driving roller 152 and the secondary transfer roller 160, while being firmly held by the driving roller 152 and the secondary transfer roller 160. The full color toner image is transferred (the second transfer), onto the recording sheet when the recording sheet passes between the driving roller 152 and the secondary transfer roller 160 at an appropriate timing.

The recording sheet carrying the full color toner image is conveyed further into a fusing unit 107. When the recording sheet passes through the fusing unit 107, the recording sheet is heated and pressed, and thereby the full color image is fused and fixed on the recording sheet.

In either the direct-transfer image forming apparatus 10*a* or the indirect-transfer image forming apparatus 10*b*, the toner images of different colors on the respective photo conductor drums 102C, 102M, 102Y, 102K, which are at different positions on the transfer belt 151, are transferred directly to the recording sheet, or to the transfer belt 151.

If the images of different colors are formed on the respective photo conductor drums 102C, 102M, 102Y, 102K and transferred to the transfer belt 151 at the same time, it is apparent that the toner images of different colors are transferred to different positions on the transfer belt 151, that is, color deviation occurs. To avoid this problem, the controller 110 adjusts the timings of outputting monochromatic image data signals to the respective optical writing units 101C, 101M, 101Y, 101K by incorporating time delays corresponding to intervals of the photo conductor drums 102C, 102M, 102Y, 102K along the transfer belt 151.

For example, if the intervals of the photo conductor drums 102C, 102M, 102Y, 102K along the transfer belt 151 are 10.0 cm, and the moving speed of the transfer belt 151 is 10.0 cm/second, the timings of writing the monochromatic images by the respective optical writing units 101C, 101M, 101Y, 101K to the respective photo conductor drums 102C, 102M, 102Y, 102K are shifted by one second consecutively.

However, even though the driving roller 152 drives the transfer belt 151 at a constant rotational speed, if the moving speed of the transfer belt 151 is not constant within one cycle, that is, the distance through which the transfer belt 151 moves per unit time, for example, per second, is not a constant, then transfer positions, at which images of different colors are transferred, are different. As a result, color deviation occurs in the superposed color image transferred on the recording sheet or the transfer belt 151.

For this reason, in order to suppress color deviation in the color image forming apparatus having the tandem engine configuration, it is required that the moving speed of the transfer belt 151 be constant within one cycle, or at least within the period when the toner image is being transferred.

The moving speed V of the outer surface of the transfer belt 151, to which the toner image is transferred, can be expressed as below, $$V=(R+r)\omega t \tag{1}$$

where, R represents the radius of the driving roller 152, r represents the thickness of the transfer belt 151, and ω represents the angular speed of the driving roller 152.

It is relatively easy to machine the radius R of the driving roller 152 at high precision. However, because the transfer belt 151 is film-like, that is, it is relatively long, and relatively thin and narrow, it is difficult to fabricate the transfer belt 151 to have a uniform thickness, especially in the longitudinal direction (that is, the rotation direction).

If the thickness of the transfer belt 151 is not uniform over the total length thereof, even if the speed of the driving roller 152, which drives the transfer belt 151, is controlled to be constant, the moving speed of the transfer belt 151 ends up varying periodically.

Specifically, if the lower limit of the thickness of the transfer belt 151 is r_min, the upper limit of the thickness of the transfer belt 151 is r_max, variation Δr of the thickness of the transfer belt 151 over the length thereof is in the following range:

$$0 \leqq \Delta r \leqq (r_\max - r_\min).$$

With Δr, the equation (1) can be rewritten as $$V=(R+(r_\min+\Delta r)\omega t \tag{2}$$

Δr is a function of a position on the transfer belt 151 along the longitudinal direction. Below, a certain position on the transfer belt 151 along the longitudinal direction is represented by x, and Δr is expressed as Δr(x) . Because Δr(x) changes with the contacting position of the outer circumference of the driving roller 152 with the transfer belt 151, even if the angular speed of the driving roller 152 is constant, the moving speed V of the outer surface of the transfer belt 151 changes.

As described above, in the color image forming apparatuses having the tandem engine configuration, variation of the thickness of the transfer belt 151 causes transfer positions, at which images of different colors are transferred, to be different from each other, and as a result, color deviation occurs in the output color image.

In principle, it is possible to prevent the color deviation by managing to control the moving speed of the transfer belt 151 to be constant regardless of thickness variation of the transfer belt 151 in the longitudinal direction. Specifically, the angular speed of the driving roller 152 is controlled to be in such a way that the angular speed of the driving roller 152 is decreased when the portion of the transfer belt 151 contacting the outer circumference of the driving roller 152 is thick, and is increased when the portion of the transfer belt 151 contacting the outer circumference of the driving roller 152 is thin.

Followings are the methods proposed so far for suppressing the variation of the moving speed of the transfer belt 151.

In the method disclosed in Japanese Laid-Open Patent Application 6-127037, a striped pattern is formed on the transfer belt, and the moving speed of the transfer belt is measured by detecting the pattern using a sensor, and a polygonal motor is controlled by feeding back the measured speed.

In the method disclosed in Japanese Laid-Open Patent Application 11-174932, an encoder is attached to the axle of the driven roller that supports the transfer belt, and the speed of the transfer belt is controlled by feeding back the output from the encoder.

In the method disclosed in Japanese Laid-Open Patent Application 2001-51479, variation of the thickness of the transfer belt is measured in advance, and based on the measured variation of the belt thickness, the write timing of different colors are controlled, thereby reducing variation of the moving speed of the transfer belt.

However, in the method disclosed in Japanese Laid-Open Patent Application 6-127037, although it is possible to measure the moving speed of the outer surface of the transfer belt accurately, it is difficult to form the striped pattern on the belt, and this increases the fabrication cost.

Further, depending on the control method used in the control, a sensor of a high resolution may be necessary, and a circuit exclusively used for the feedback control of the signals from the sensor becomes necessary. Consequently, the apparatus becomes quite expensive.

In the method disclosed in Japanese Laid-Open Patent Application 11-174932, because additional parts like the driven roller, the encoder, and a circuit exclusively used for the feedback control are necessary, the apparatus becomes quite expensive.

In the method disclosed in Japanese Laid-Open Patent Application 2001-51479, because the thickness variation of the transfer belt is measured in advance in factories before shipment, and the write timing of different colors are controlled based on the measured data, it is not necessary to install detection devices, such as encoders, in the apparatus, and thereby, cost of the system is relatively low.

However, variations in the thickness of a transfer belt are caused by fluctuations in the fabrication condition of the transfer belt, and different transfer belts have respectively different thickness uncertainties. Therefore, measured thickness variation of one belt cannot be used for other belts. For this reason, when exchanging a transfer belt, it is necessary to set data of thickness variation of the belt to be used into the apparatus.

Because the transfer belt is a consumable article, after printing a certain number of recording sheets, the transfer belt has to be exchanged. Among the color image forming apparatuses, usually it is the user himself that exchanges the belt unit of a color printer, while usually a service personnel performs maintenance on a facsimile machine or a copier for the users. When the user exchanges the belt unit, it becomes necessary to attach belt thickness variation data with the new belt, and the user has to set the data into the printer by operating an operational panel. This operation is cumbersome, and if the setting is wrong by mistake, expected printing quality cannot be obtained, or the printing quality may be much degraded.

SUMMARY OF THE INVENTION

Accordingly, it is a general object of the present invention to solve one or more problems of the related art.

A specific object of the present invention is to provide an image forming apparatus capable of automatically acquiring data of variation of thickness of a transfer belt newly installed in the image forming apparatus without manual operation of setting the data, and capable of controlling the moving speed of the newly installed transfer belt to be constant based on the acquired data so as to output images of high quality constantly.

According to the present invention, there is provided an image forming apparatus comprising a plurality of photo conductors arranged in series with a plurality of monochromatic color images formed thereon respectively, the monochromatic color images being color components of a target color image; a transfer belt that is wound on a rotating driving roller and moves along a longitudinal direction thereof, the monochromatic color images on the photo conductors being transferred to said transfer belt sequentially and superposed on the transfer belt to form the target color image; a rotational speed control unit configured to control an rotating angular speed of the driving roller while making reference to rotational speed correction data so that a moving speed of the transfer belt in the longitudinal direction is maintained to be constant regardless of variation of thickness of the transfer belt in the longitudinal direction, said rotational speed correction data being created based on a relation between a position on the transfer belt in the longitudinal direction thereof and a thickness of the transfer belt at the position.

The transfer belt includes a belt information mark recorded with information used for creating the rotational speed correction data; and the rotational speed control unit includes a storage unit configured to store the rotational speed correction data; a belt information reading unit configured to read the belt information mark to obtain the information thereon used for creating the rotational speed correction data; and a correction data updating unit configured to update and store the rotational speed correction data based on the information read from the belt information mark.

As an embodiment, the belt information mark includes an optically readable pattern; and the belt information reading unit optically reads the belt information mark and acquires the information for creating the rotational speed correction data.

As an embodiment, the belt information mark includes a magnetically readable pattern; and the belt information reading unit magnetically reads the belt information mark and acquires the information for creating the rotational speed correction data.

As an embodiment, the position of the belt information mark on the transfer belt is also used as a reference position for determining the position on the transfer belt in the longitudinal direction.

As an embodiment, the image forming apparatus further comprises a belt exchange detection unit configured to detect whether the transfer belt is newly exchanged. The correction data updating unit updates and stores the rotational speed correction data based on the information read from the belt information mark only when the belt exchange detection unit determines that the transfer belt is newly exchanged.

As an embodiment, the image forming apparatus further comprises a speed limitation unit configured to control the moving speed of the transfer belt when the belt information mark is read so that the moving speed of the transfer belt is lower than a usual moving speed of the transfer belt when forming the target color image.

As an embodiment, a recording sheet is closely attached onto the transfer belt; and the monochromatic color images on the photo conductors are directly transferred onto the recording sheet sequentially and superposed on the recording sheet to form the target color image.

As an embodiment, the monochromatic color images on the photo conductors are transferred sequentially and superposed onto the transfer belt to form the target color image; and the superposed the target color image is transferred again onto a recording sheet.

These and other objects, features, and advantages of the present invention will become more apparent from the following detailed description of preferred embodiments given with reference to the accompanying drawings.

DESCRIPTION OF THE PREFERRED EMBODIMENTS

Below, preferred embodiments of the present invention are explained with reference to the accompanying drawings.

Figure 3:
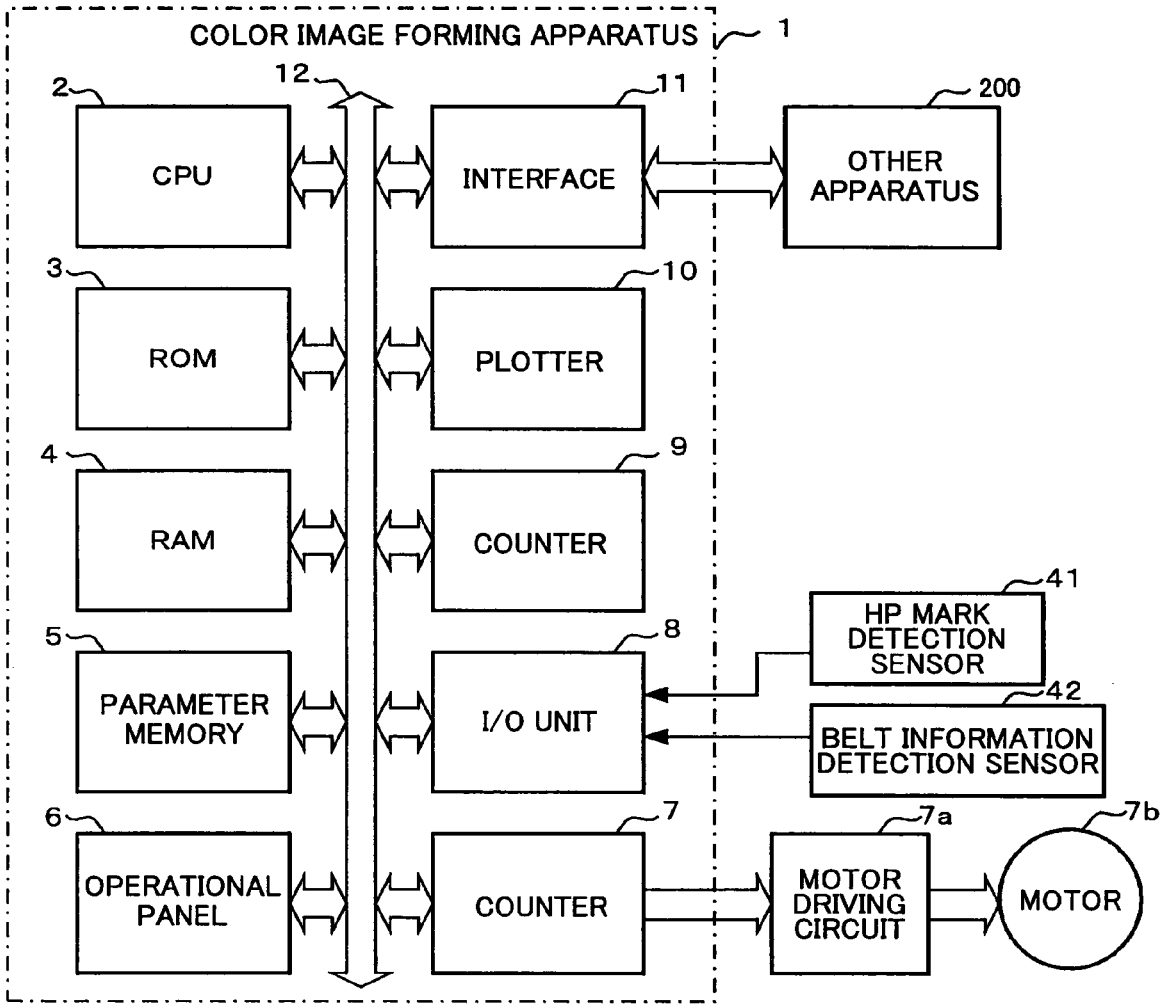
FIG. 3 is a block diagram showing a schematic configuration of a color image forming apparatus 1 according to an embodiment of the present invention.

FIG. 3 is a block diagram showing a schematic configuration of a color image forming apparatus 1 according to the present embodiment.

Figure 1:
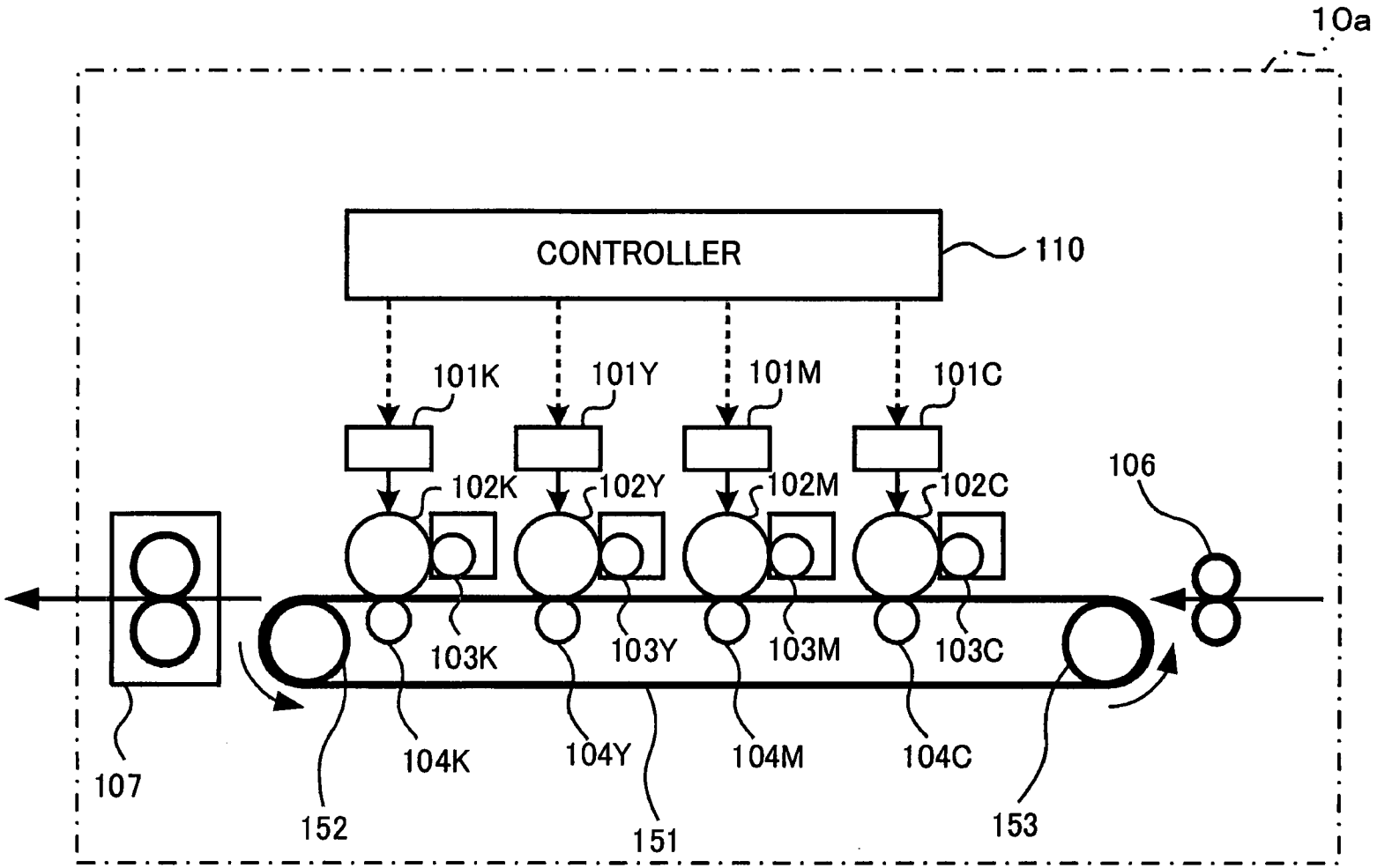
FIG. 1 is a schematic view showing a configuration of a direct-transfer image forming apparatus 10*a;*

The color image forming apparatus 1 illustrated in FIG. 1 includes a CPU (Central Processing Unit) 2, a ROM (Read-Only Memory) 3, a RAM (Random Access Memory) 4, a parameter memory 5, an operational panel 6, a motor 7*b*, a motor controller 7, a motor driving circuit 7*a*, an I/O unit 8, a counter 9, a plotter 10, an interface 11, and system buses 12.

The CPU 2 executes control programs stored in the ROM 3, and controls components of the color image forming apparatus while using a working area of the RAM 4.

The ROM 3 stores the aforesaid control programs for use of the CPU 2, and permanent data referred by the control programs while being executed.

The RAM 4 provides a working area for the CPU 2 to store temporal data, for example when extending image data equaling one page to be printed.

The parameter memory 5 is for storing data related to the control system of the color image forming apparatus, for example, for permanently storing data used for starting up the image forming apparatus even after the power of the color image forming apparatus is turned off. For example, the parameter memory 5 may include an SRAM (Static Random Access Memory) powered by a battery, or an EEPROM (Electrically Erasable Programmable Read Only Memory).

The operational panel 6 includes various keys for inputting instructions to the color image forming apparatus (for example, input an instruction for compulsively stopping printing operation), and a display, such as a liquid crystal display, for showing current operational condition of the color image forming apparatus and various messages to users.

The motor 7*b* is driven by driving signals from a motor controller 7 through a motor driving circuit 7*a*, and the rotational speed of the motor 7*b* is adjusted in response to the driving signals. The motor 7*b* drives a driving roller 32 described below. The motor controller 7 corresponds to the rotational speed control unit of the invention.

The I/O unit 8 includes a number of input and output ports. Detection signals from a HP (home position) mark detection sensor 41 or from a belt information detection sensor 42 are input to the I/O unit 8.

The counter 9 is used for count time related control of the apparatus, such as mark detection time by the sensors.

The plotter 10 fuses a target image on a recording sheet and outputs the recording sheet, and is particularly configured to process color images. The plotter 10 corresponds to the "image forming unit" of the present invention.

The interface 11 receives image data accompanying a printing request sent from a personal computer or other apparatus 200, and transfers the image data to the CPU 2. For example, the interface 11 may be a LAN interface.

The system bus 14 includes signal lines for exchanging data among the above components. For example, the system bus 14 may include a data bus, a control bus, an I/O bus, and/or others.

Figure 4:
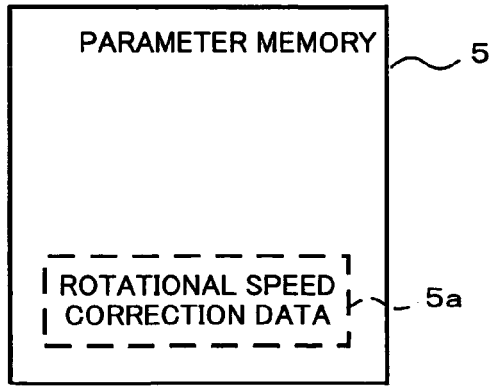
FIG. 4 is a block diagram showing a schematic configuration of the parameter memory 5 according to the present embodiment.

FIG. 4 is a block diagram showing a schematic configuration of the parameter memory 5 according to the present embodiment.

As illustrated in FIG. 4, in the parameter memory 5, rotational speed correction data are stored in a storage area 5*a*. The storage area 5*a* corresponds to the correction data storage unit of the present invention.

The rotational speed correction data is based on a relation between a position on a transfer belt 31 (described below) in its longitudinal direction and the thickness of the transfer belt 31 at that position. The motor controller 7, while making reference to the rotational speed correction data, controls the angular speed of the driving roller 32 so that the moving speed of the transfer belt 31 in the longitudinal direction is maintained to be constant regardless of thickness variation of the transfer belt 31.

Figure 5:
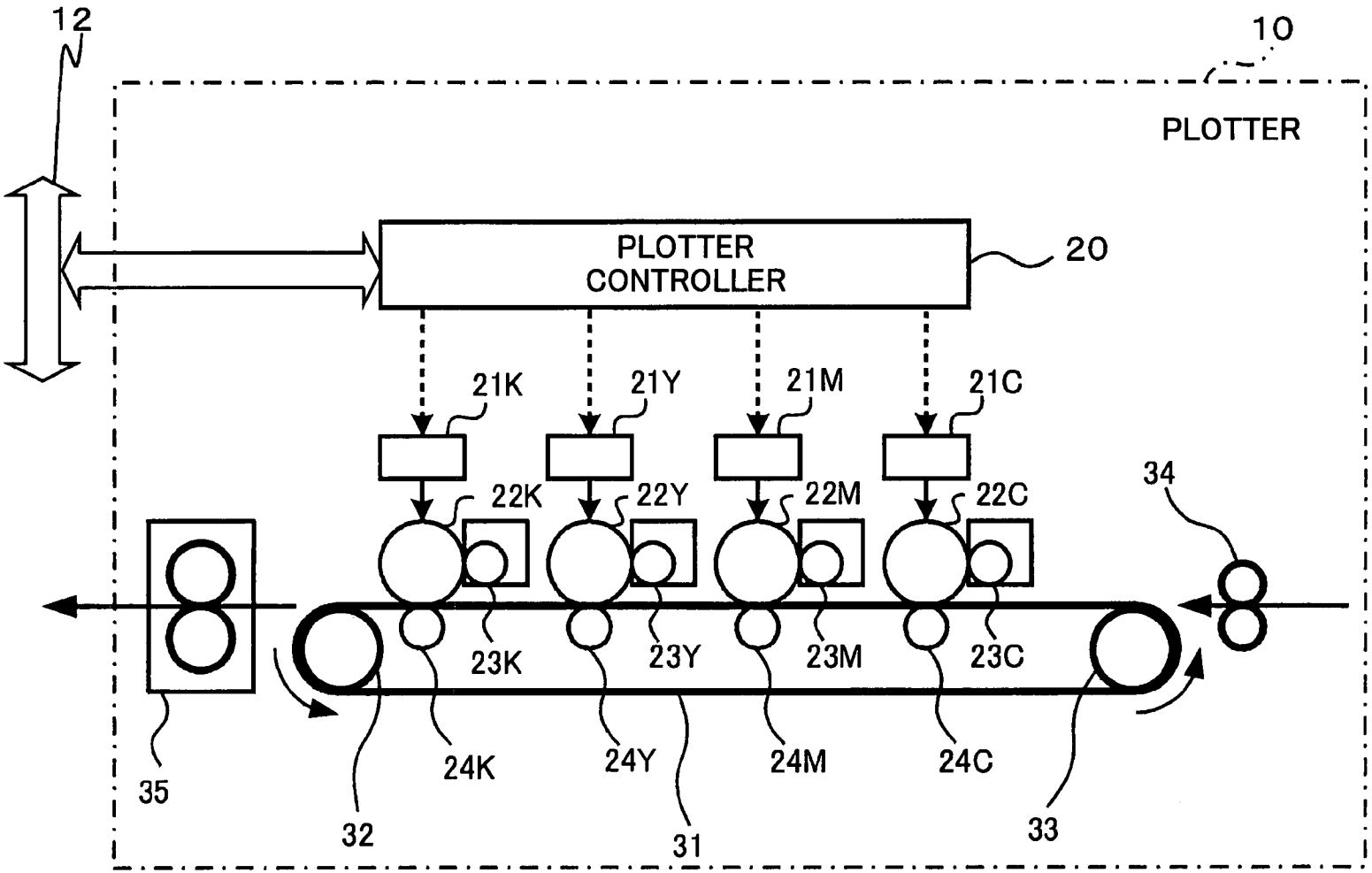
FIG. 5 is a schematic view showing a configuration of the plotter 10.

FIG. 5 is a schematic view showing a configuration of the plotter 10.

The plotter 10 is a direct-transfer image forming apparatus having a tandem engine configuration capable of color image formation.

As illustrated in FIG. 5, in the plotter 10, a transfer belt 31, which is a flexible belt, is wound on a driving roller 32 (driven by the motor 7*b*) and a driven roller 33. The upper part of the transfer belt 31 is placed between photo conductor drums 22C, 22M, 22Y, 22K for forming cyan (C), magenta (M), yellow (Y), and black (K) monochromatic images, respectively, and the correspondingly arranged transfer rollers 24C, 24M, 24Y, 24K, and is driven to move in the left direction in FIG. 5.

The surface of each of the photo conductor drums 22C, 22M, 22Y, 22K is uniformly charged by a not-illustrated charging device. Optical writing units 21C, 21M, 21Y, 21K, which are controlled by a plotter controller 20, emit modulated laser beams according to the cyan, magenta, yellow, and black monochromatic image data onto the charged surfaces of the photo conductor drums 22C, 22M, 22Y, 22K. Thereby, the charged surfaces of the photo conductor drums 22C, 22M, 22Y, 22K are neutralized, and latent images are formed on the surfaces of the photo conductor drums 22C, 22M, 22Y, 22K.

When the thus formed latent images move between the corresponding photo conductor drums 22C, 22M, 22Y, 22K and the developing devices 23C, 23M, 23Y, 23K, cyan, magenta, yellow, and black monochromatic toners stored in the respective developing devices 23C, 23M, 23Y, 23K are added onto the respective latent images by the developing devices 23C, 23M, 23Y, 23K, and thereby, the latent images are converted into visible toner images.

On the other hand, a recording sheet is conveyed by a pair of conveyance rollers 34 and is closely attached onto the upper part of the transfer belt 31 and moves together with the transfer belt 31. When the recording sheet moves through pairs of the photo conductor drums 22C, 22M, 22Y, 22K and the transfer rollers 24C, 24M, 24Y, 24K, sequentially, the cyan, magenta, yellow, and black monochromatic toner images on the photo conductor drums 22C, 22M, 22Y, 22K are sequentially and directly transferred onto and are superposed on the recording sheet. As a result, a superposed full color image is formed on the surface of the recording sheet.

The recording sheet carrying the superposed full color image is further conveyed into a fusing unit 35. When the recording sheet passes through the fusing unit 35, the recording sheet is heated and pressed, and thereby the superposed full color image is fused and fixed on the recording sheet.

Specifically, the interface 11 receives image data accompanying a printing request sent from the other apparatus 200, and transfers the image data to the CPU 2. The CPU 2 transfers the image data to the plotter controller 20 via the system bus 12.

In the plotter controller 20, the received image data are decomposed into cyan (C), magenta (M), yellow (Y), and black (K) monochromatic image data, and these image data are converted into writing data for controlling writing operations of the optical writing units 21C, 21M, 21Y, 21K.

Optical writing units 21C, 21M, 21Y, 21K, emit laser beams, which are modulated according to the writing data corresponding to the cyan, magenta, yellow, and black monochromatic image data, onto the charged surfaces of the photo conductor drums 22C, 22M, 22Y, 22K, and thereby, latent images corresponding to the cyan, magenta, yellow, and black monochromatic image data are formed on the surfaces of the photo conductor drums 22C, 22M, 22Y, 22K.

The latent images on the photo conductor drums 22C, 22M, 22Y, 22K are developed by the developing devices 23C, 23M, 23Y, 23K, and are converted into visible toner images of cyan, magenta, yellow, and black colors, respectively.

The cyan, magenta, yellow, and black monochromatic toner images on the photo conductor drums 22C, 22M, 22Y, 22K are sequentially and directly transferred onto the recording sheet when it is moving through pairs of the photo conductor drums 22C, 22M, 22Y, 22K and the transfer rollers 24C, 24M, 24Y, 24K, sequentially, and the cyan, magenta, yellow, and black monochromatic toner images are superposed as a full color image on the recording sheet.

The transfer belt 31 is driven by the motor 7*b*, which is connected to the axle of the driving roller 32, and is controlled to move at a constant speed. However, because of variation of the thickness of the transfer belt 31 in the longitudinal direction, if the angular speed of the driving roller 32 is fixed to be a constant, the moving speed on the surface of the transfer belt 31 varies periodically and undulatorily.

In order to correct the periodical and undulating speed variation, as shown in FIG. 4, the rotational speed correction data are stored in the storage area 5*a*. The rotational speed correction data may include data of thickness variation of the transfer belt 31 over the length of the transfer belt 31, alternatively, data of variation of the moving speed of the transfer belt 31 due to the thickness variation of the transfer belt 31. The rotational speed of the axle of the driving roller 32 on which the transfer belt 31 is wound is controlled; that is, the rotating speed of the motor 7*b* is controlled based on the rotational speed correction data so as to reduce the variation of the moving speed of the transfer belt 31.

Data of thickness variation of the transfer belt 31 at positions over the length of the transfer belt 31 may be directly stored in the storage area 5*a* as the rotational speed correction data, and when controlling the rotating speed of the motor 7*b*, frequencies of pulses used for motor speed control may be calculated in real-time based on the thickness variation data.

Alternatively, frequencies of pulses used for motor speed control may be calculated in advance based on thickness variation data of the transfer belt 31 at positions over the length of the transfer belt 31, and stored in the storage area 5*a* as the rotational speed correction data, and when controlling the rotating speed of the motor 7*b*, one may just read out the frequency data in the storage area 5*a*.

That is, the rotational speed correction data stored in the storage area 5*a* may have any kind of form, as long as it is possible to control, based on thickness variation data of the transfer belt 31 at positions over the length of the transfer belt 31, the moving speed of the transfer belt 31 to be constant over the length of the transfer belt 31. The present invention is not limited to the forms of the rotational speed correction data.

Because controlling the moving speed of the transfer belt 31 in the longitudinal direction thereof is realized by correcting speed variation, which is synchronized with the rotational cycle of the transfer belt 31, by means of controlling the rotating speed of the driving roller 32, it would be useful for the control system to know the present position of the transfer belt 31 in the longitudinal direction in contact with the outer circumference of the driving roller 32.

For this purpose, a mark indicating a reference position is set on the edge of the transfer belt 31, which is referred to as "Home Position Mark".

Figure 6:
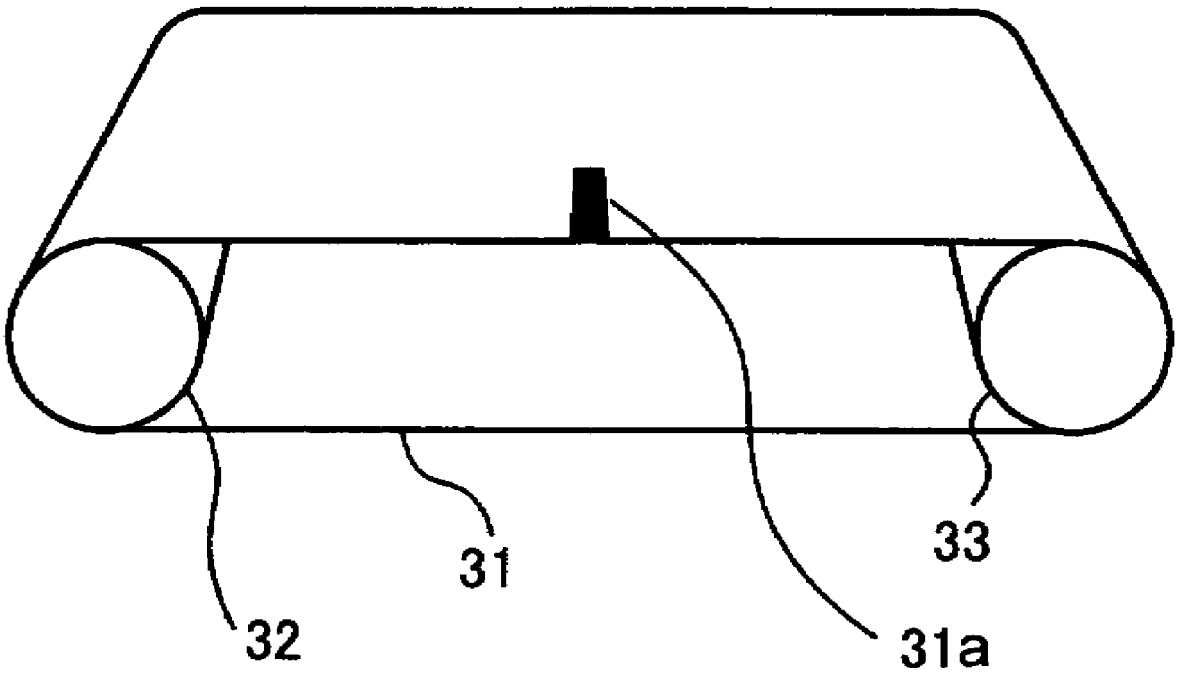
FIG. 6 is a schematic view showing a home position (HP) mark 31*a* on the transfer belt 31.

FIG. 6 is a schematic view showing an exemplary home position (HP) mark 31*a* on the transfer belt 31. In the example illustrated in FIG. 6, the home position (HP) mark 31*a* is set on the edge of the transfer belt 31 for determining the present position of the transfer belt 31 in the longitudinal direction.

Figure 7:
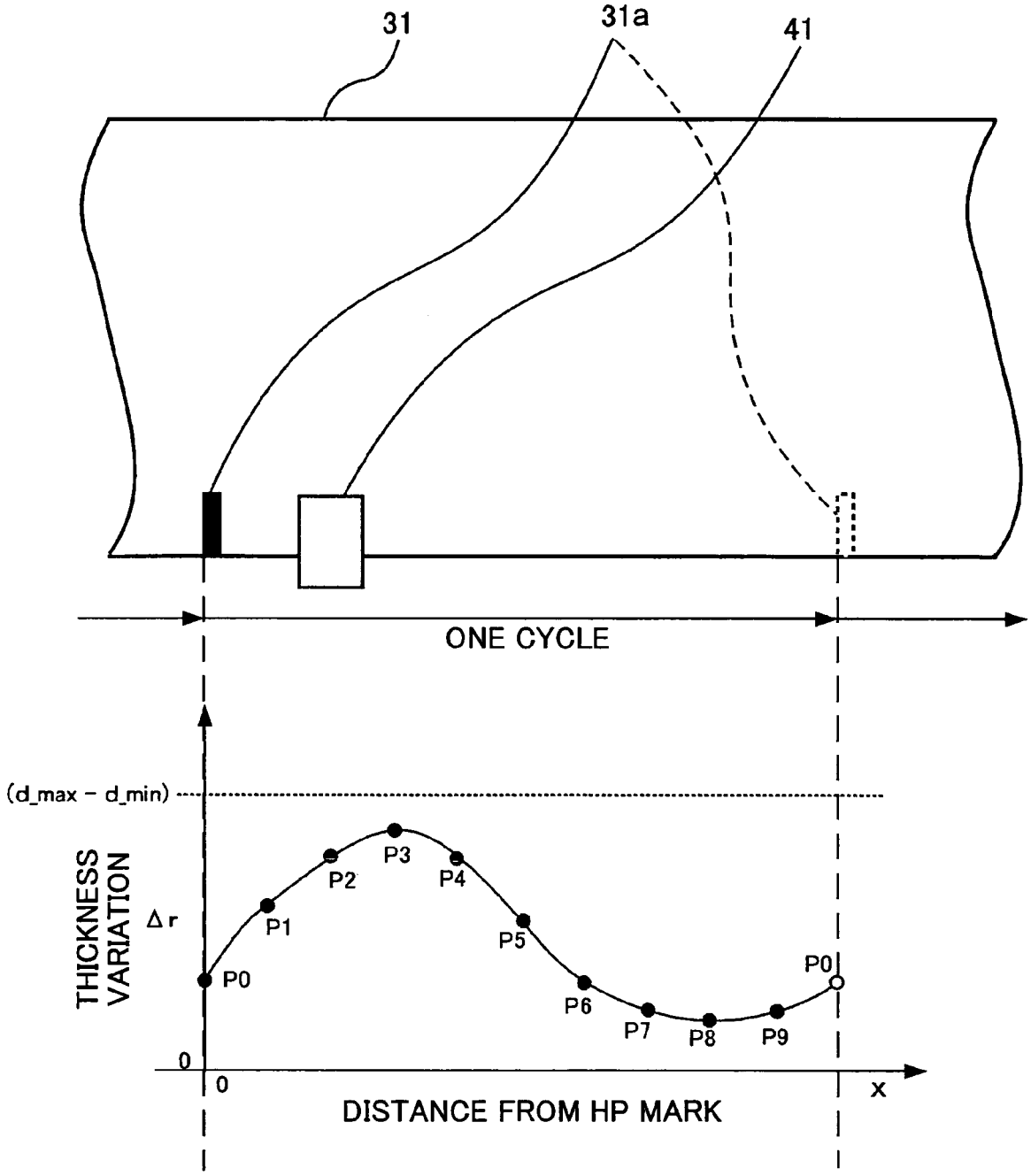
FIG. 7 is a schematic view showing thickness variation of the transfer belt 31 at positions within the total length of the transfer belt 31.

FIG. 7 is a schematic view showing thickness variation of the transfer belt 31 at positions within the total length of the transfer belt 31.

As illustrated in FIG. 7, variation Δr of the thickness of the transfer belt 31 at positions within the total length of the transfer belt 31 is in the following range: 0<Δr <(r_max−r_min), where r_min represents the lower limit of the thickness of the transfer belt 31, and r_max represents the upper limit of the thickness of the transfer belt 31. The variation Δr of the thickness is due to fluctuations in the fabrication condition, and varies in an undulating manner along with a distance x relative to the HP mark 31*a* in the longitudinal direction. The characteristic of the thickness variation differs belt by belt, and is an intrinsic characteristic of each belt.

The present invention is not limited to definitions of data used for representing the variation Δr of the thickness of the transfer belt 31 over the total length of the transfer belt 31; that is, the present invention is not limited to definitions of data from which the rotational speed correction data are deduced. In the illustrated embodiment shown in FIG. 7, for example, the following definition is adopted. With the HP mark 31*a* as a starting position, the total length of the transfer belt 31 is divided into 10 sections at positions P0 through P9, and the thickness variation Δr at the positions P0 through P9 is considered.

For example, if the thickness variation Δr is represented by four bits, the value of the upper limit corresponding to (r_max−r_min) can be represented by 15, and the value of the lower limit can be represented by 0. For example, the thickness variation Δr can be represented by a series of (7, 6, 5, 6, 7, 8, 9, 10, 9, 8). From this data series, the actual thickness variation Δr of the transfer belt 31 at the positions P0 through P9, that is, over the length of the transfer belt 31, can be deduced.

The moving speed of the transfer belt 31 is also expressed by equation 2, that is, $$V=(R+(r_\min+\Delta r)\omega t,$$

Here, R represents the radius of the driving roller 32, r represents the thickness of the transfer belt 31, and ω represents the angular speed of the driving roller 32.

The angular speed ω of the driving roller 32 resulting in a constant moving speed V, that is, the moving speed V is independent of the thickness variation Δr. The angular speed ω can be expressed as a function of the position x defined with the HP mark 31*a* of the transfer belt 31 as a reference position, indicating variation of the moving speed V.

Figure 8:
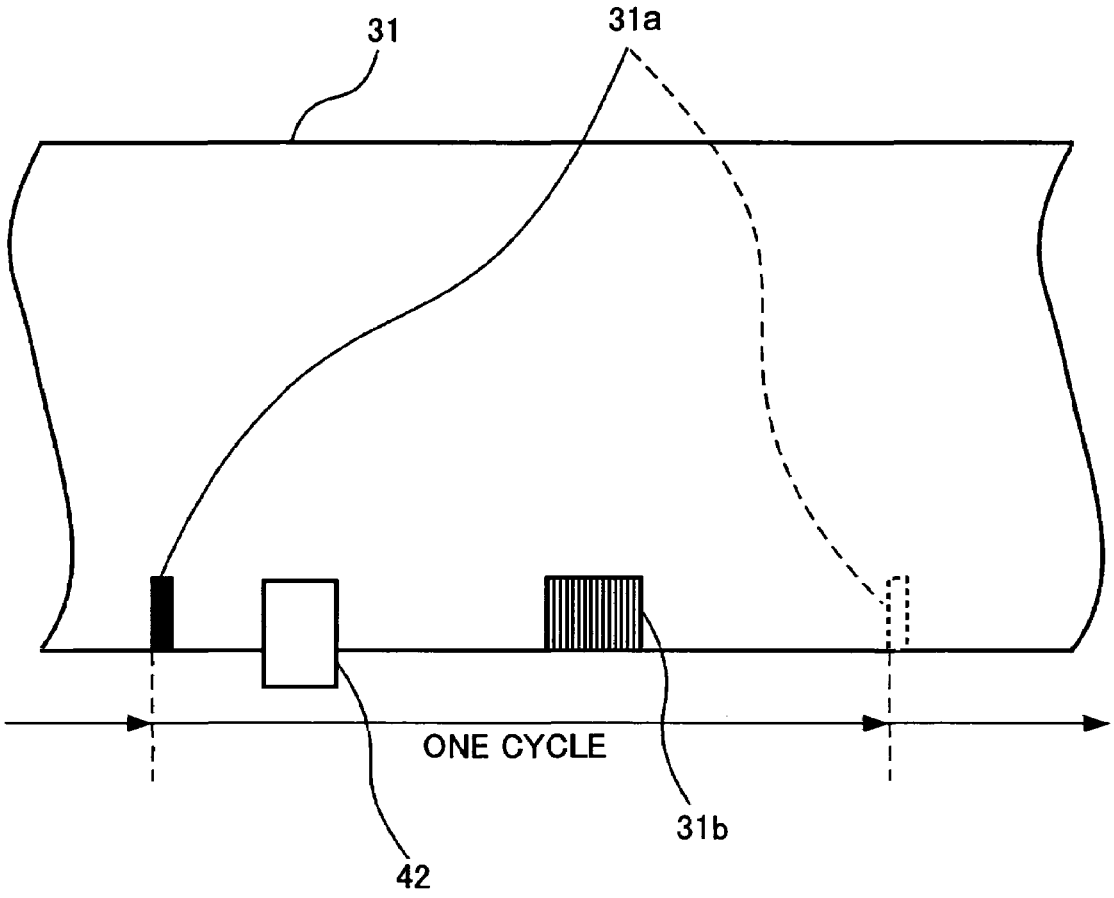
FIG. 8 is a schematic view of the transfer belt 31 including both the HP mark 31*a* and a belt information mark 31*b;*

FIG. 8 is a schematic view of the transfer belt 31 including both the HP mark 31*a* and a belt information mark 31*b*.

As illustrated in FIG. 8, in the present embodiment, the transfer belt 31 has the HP mark 31*a* and a belt information mark 31*b*. The belt information mark 31*b* is set on the edge of the transfer belt 31, and is for indicating thickness variation of the transfer belt 31 over the total length of the transfer belt 31, or speed variation over the total length of the transfer belt 31 deduced from the thickness variation. The HP mark 31*a* and the belt information mark 31*b* are placed at positions outside the working area of the transfer belt 31, in which a full color image is superposed.

The belt information mark 31*b* is detected by the belt information detection sensor 42, which is on the side of the main body of the color image forming apparatus 1.

The belt information detection sensor 42 corresponds to the belt information reading unit of the present invention.

The thickness variation data of the transfer belt 31, indicated by the belt information mark 31*b*, for example, are obtained by measuring each transfer belt 31 in fabrication in advance with high precision measurement devices.

The present invention is characterized in that the transfer belt 31 itself carries information of the thickness variation or information of the speed variation deduced from the thickness variation, which are indicated by the belt information mark 31*b*.

Next, an explanation is given of the operation of updating the rotational speed correction data stored in the storage area 5*a*, and an operation of forming a color image on the basis of the updated rotational speed correction data.

Figure 9:
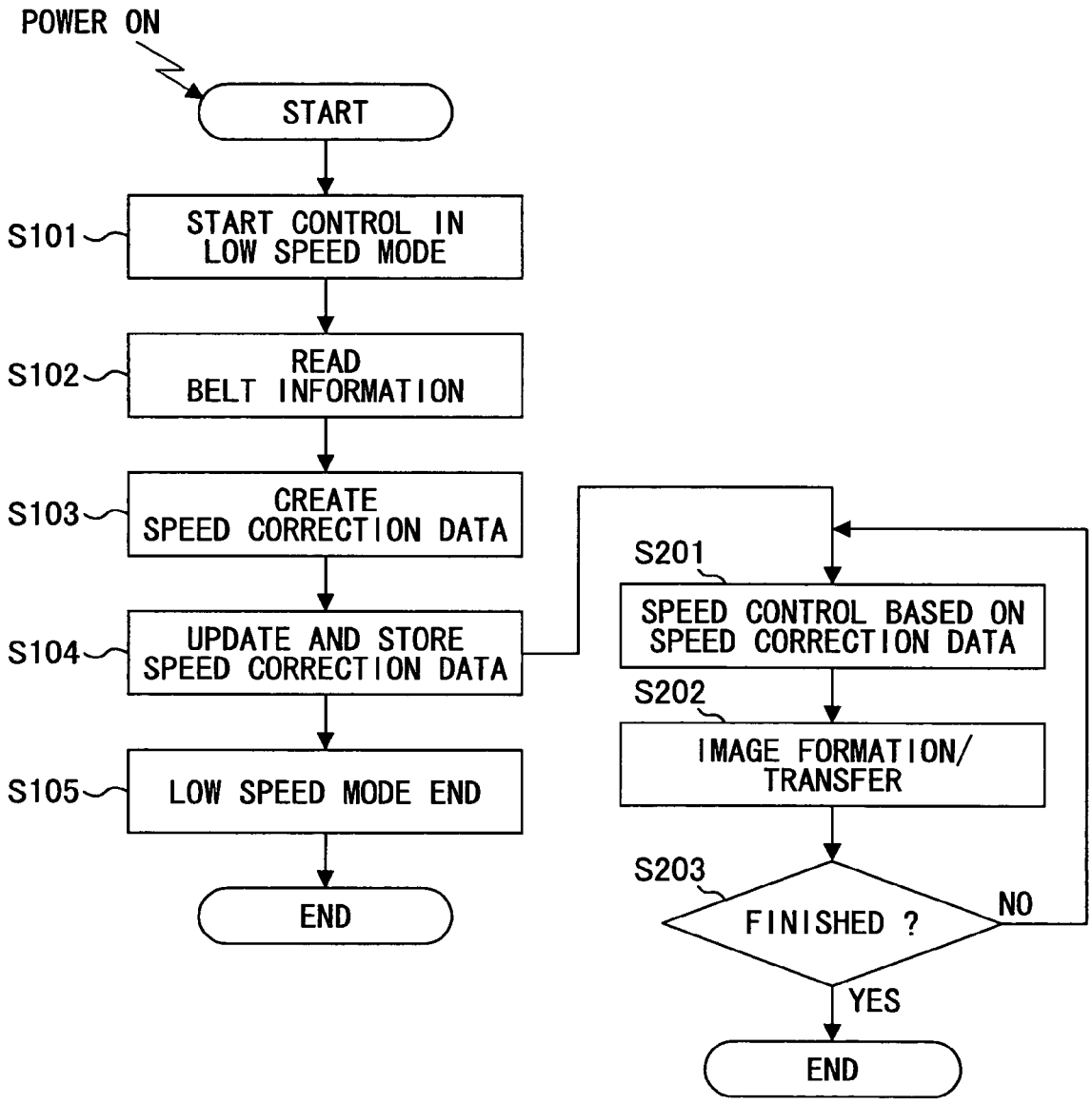
FIG. 9 is a flow chart showing the operation of updating the rotational speed correction data.

FIG. 9 is a flow chart showing the operation of updating the rotational speed correction data.

After the power of the color image forming apparatus is turned on, the CPU 2 initializes the system, and one of the initialization operations is updating the rotational speed correction data.

In the operation of updating the rotational speed correction data, first, in step S101, the motor controller 7 drives the motor 7*b* to be in a low rotating speed mode, that is, the motor 7*b* is driven to rotate at a speed lower than the usual rotational speed during operation of image formation. The operation in step S101 corresponds to the speed limitation step of the present invention.

In step S102, due to the low-speed mode control, the driving roller 32 rotates slowly, at the same time, this starts moving conveyance of the transfer belt 31. Then, the operation of reading the belt information is started.

Although the step S101 may be omitted, and the motor 7*b* may be driven to rotate at the same speed as that during image formation, execution of step S101 prior to the operation of updating the rotational speed correction data has the following advantage.

Generally, a stepping motor or a PLL servo motor is used as the motor 7*b*, because it is necessary to perform speed control of the motor 7*b*, which drives the transfer belt 31, at a high precision. When detecting the belt information mark 31*b*, if the rotating speed of the motor 7*b*, such as a stepping motor or a PLL servo motor, is decreased, for example, by lowering the frequency of the clock supplied to the motor driving circuit 7*a* from the motor controller 7, detection accuracy of the belt information mark 31*b* can be improved, because if the transfer belt 31 moves at a low speed when detecting belt information represented by the belt information mark 31*b*, the belt information mark 31*b* can be more reliably detected. Detection performance of the belt information detection sensor 42 is high when the transfer belt 31 moves at a low speed. Therefore, accurate belt information detection can be realized by simply decreasing the rotating speed of the motor 7*b*, and complicated devices for high precision belt information detection are not necessary, and thus cost of the apparatus can be suppressed.

In step S102, after the HP mark 31*a* is detected by the HP mark detection sensor 41, the belt information mark 31*b* is detected, and the corresponding information is obtained by the belt information detection sensor 42. For example, the obtained thickness variation data are acquired by the CPU 2.

In step S103, the CPU 2 re-creates the rotational speed correction data based on the obtained thickness variation data.

In step S104, the CPU 2 stores the new rotational speed correction data in the storage area 5*a* of the parameter memory 5, that is, to update the rotational speed correction data.

In step S105, the low rotating speed mode of the motor 7*b* is ended, and the operation of updating the rotational speed correction data is finished.

If the power-ON prior to the above updating operation is the first time power-ON after exchange of the unit including the transfer belt 31, in step S104, the rotational speed correction data is updated for the newly installed transfer belt 31.

If the power-ON prior to the above updating operation is not the first time power-ON after exchange of the unit including the transfer belt 31, in step S104, the rotational speed correction data of the newly installed transfer belt 31 is written in the storage area 5*a* again, and the existing rotational speed correction data of the newly installed transfer belt 31 is updated by the same rotational speed correction data.

In either of the above cases, the correct rotational speed correction data are set into the apparatus, which correctly reflects thickness variation of the transfer belt 31 presently installed in the image forming apparatus. In operation of rotating speed correction control with reference to the rotational speed correction data, the moving speed of the transfer belt 31 is maintained to be constant.

Referring to FIG. 9 again, after the power is turned on and the image forming apparatus transits to a state ready for image formation, the operation of image formation is started according to the image data transferred from the other apparatus 200.

In step S201, the motor controller 7 controls the rotating speed of the motor 7*b* while referring to the rotational speed correction data updated in step S104.

In step S202, images of different monochromatic colors are formed, and these images are transferred to and superposed on the transfer belt 31.

In step S203, the operations of transfer and superposition in step S202 are repeated until a complete image is printed on the recording sheet. Then the image formation operation is finished.

Accordingly, even without the setting operation for the newly installed transfer belt, correction of the moving speed of the belt is performed based on the belt information. Consequently, even when the transfer belt 31 is exchanged, it is possible to obtain color images of high quality without color deviation by superposing monochromatic color images.

In the operation of updating the rotational speed correction data as illustrated in FIG. 9, the detection of the belt information mark 31*b* can be performed once, or twice or more. For example, the belt information mark 31*b* can be detected twice by rotating the transfer belt 31 for two or more cycles. These detection results can be compared, and those results in consistency can be used as the valid data. In this way, it is possible to prevent false detections.

In case the detection results of the belt information are not sufficient along the longitudinal direction of the transfer belt 31, or some of the detection results are out of the specified range, the transfer belt 31 can be rotated for an additional two, three, or more times to repeatedly detect the belt information mark 31*b* until normal results are obtained, so as to prevent false detections. In this way, the belt information can be detected more reliably, and thus, accuracy of the rotational speed correction data is improved. Consequently, it is possible to more effectively prevent color deviation caused by variation of the moving speed of the transfer belt 31.

Below, an explanation is given of detection of the belt information mark 31*b* with the belt information detection sensor 42.

Figure 10:
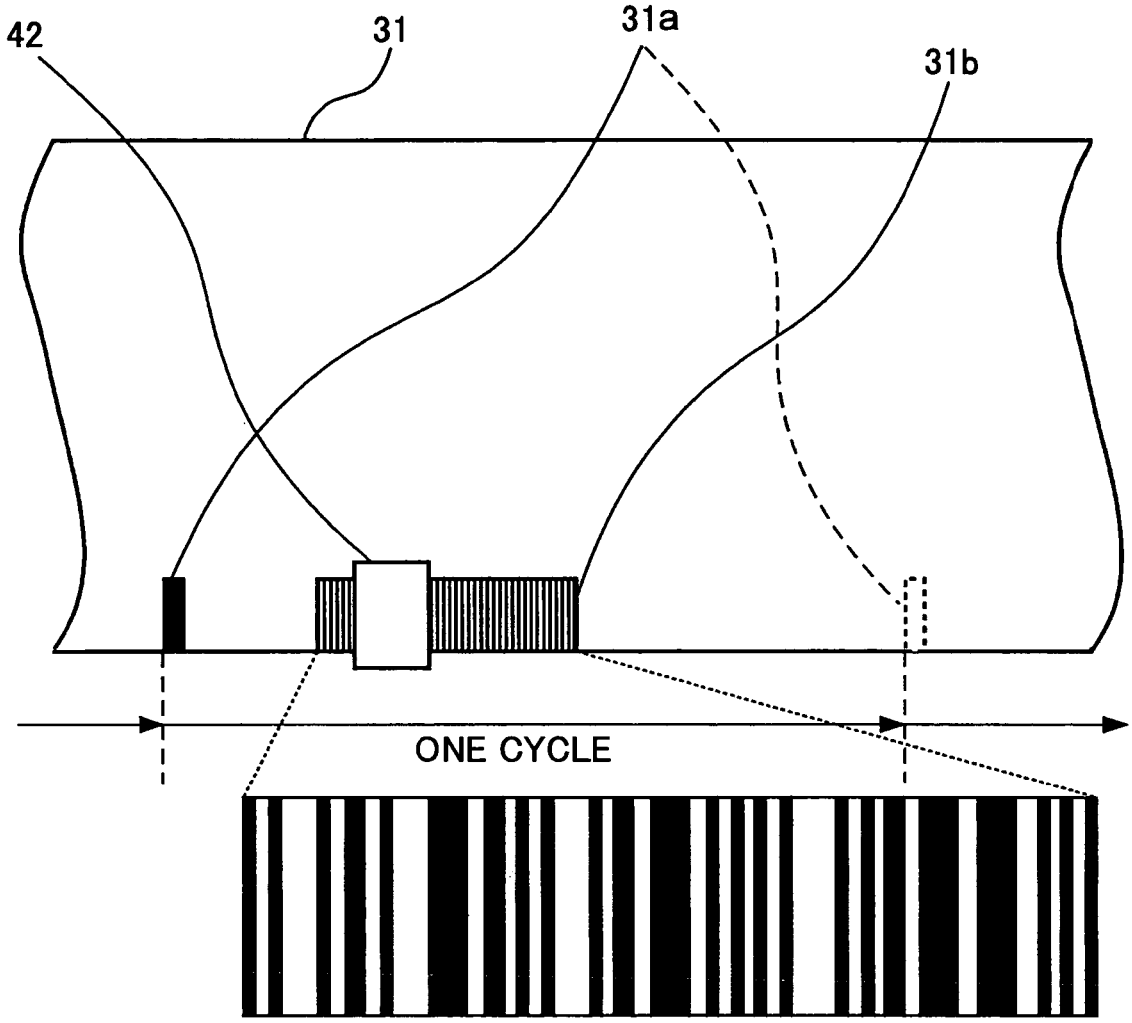
FIG. 10 is a schematic view of the transfer belt 31 for showing an example of a pattern of the belt information mark 31*b;*

FIG. 10 is a schematic view of the transfer belt 31 for showing an example of a pattern of the belt information mark 31*b*.

As illustrated in FIG. 10, the belt information mark 31*b* has a black-white striped pattern, like a bar code pattern, and is able to be detected optically. The belt information detection sensor 42 includes an optical sensor for detecting the pattern.

The optical pattern of the belt information mark 31*b* illustrated in FIG. 10 includes a header section and an ender section recorded with data for distinguishing them. When reading the belt information in the belt information mark 31*b* in the aforesaid step S102, while the transfer belt 31 is moving, it is confirmed whether the output signals from the belt information detection sensor 42 are in agreement with the data in the header section, and if the output signals are in agreement with the data in the header section, then the pattern of the belt information mark 31*b* is read optically until the output signals from the belt information detection sensor 42 are in agreement with the data in the ender section. The obtained data corresponding to the pattern of the belt information mark 31*b* are data of thickness variation of the transfer belt 31.

There are various methods of representing the thickness variation of the transfer belt 31 by an optical pattern. For example, one digital value can be represented by a group of a specified number of bars having variable widths, the so-called "digital method", or one thickness variation data can be represented by a number of bars having fixed widths, the so-called "analog method". The most appropriate method can be selected depending on the actual situation.

When detecting the optical pattern of the belt information mark 31*b* with the belt information detection sensor 42, the output signals from the belt information detection sensor 42 are converted into binary data in a comparator. A line width of a stripe of the pattern is obtained by counting the time interval between edges of the stripe using the counter 9. The same method is used when detecting the HP mark 31*a* with the HP mark detection sensor 41.

The HP mark 31*a* and the pattern of the belt information mark 31*b* can be easily distinguished by setting different line widths for them.

Figure 11A:
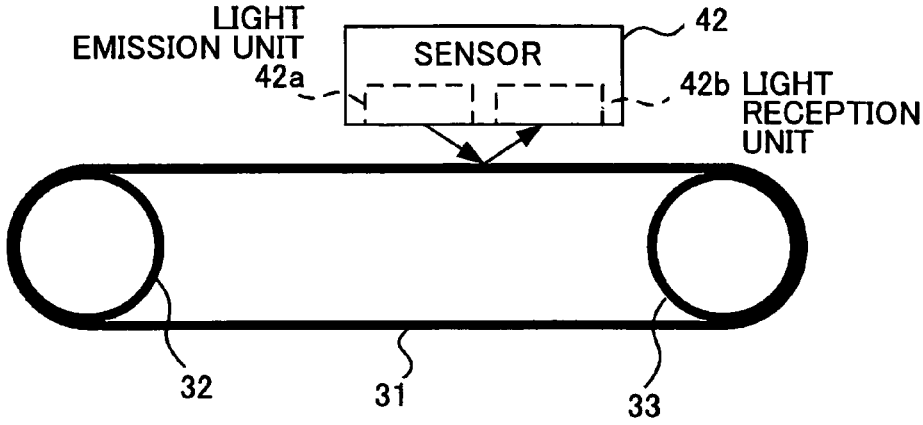
FIGS. 11A through 11C are schematic views showing examples of methods for detecting the belt information mark 31*b* including an optical pattern with the belt information detection sensor 42.
Figure 11B:
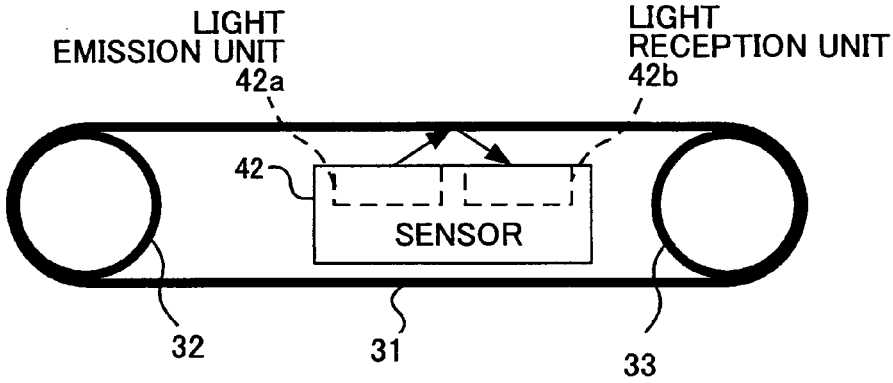
Figure 11C:
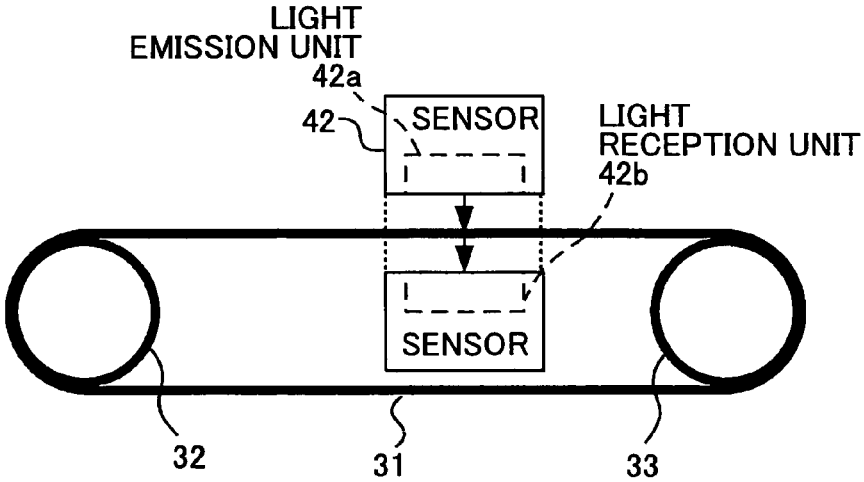

FIGS. 11A through 11C are schematic views showing examples of methods for detecting the belt information mark 31*b* including an optical pattern with the belt information detection sensor 42.

In FIG. 11A, the belt information mark 31*b* (not illustrated) on the outer surface of the transfer belt 31 is detected by the belt information detection sensor 42, which is a reflecting type sensor. Specifically, a light beam from a light emission part 42*a* of the belt information detection sensor 42, for example, formed from a laser diode or the like, is incident on the white-black pattern of the belt information mark 31*b*, and is reflected with an amount of light corresponding to the local pattern at the incident spot. The reflected light is received by a light reception part 42*b* of the belt information detection sensor 42, for example, formed from a photo diode or the like, and the belt information is obtained from the electrical signals corresponding to the received light.

In FIG. 11B, the belt information mark 31*b* (not illustrated) on the inner surface of the transfer belt 31 is detected by the belt information detection sensor 42, which is also a reflecting type sensor. Specifically, a light beam from a light emission part 42*a* of the belt information detection sensor 42, for example, formed from a laser diode or the like, is incident on the white-black pattern of the belt information mark 31*b*, and is reflected with an amount of light corresponding to the local pattern at the incident spot. The reflected light is received by a light reception part 42*b* of the belt information detection sensor 42, for example, formed from a photo diode or the like, and the belt information is obtained from the electrical signals corresponding to the received light.

In the arrangement shown in FIG. 11B, the belt information detection sensor 42 is arranged in the empty space between the driving roller 32 and the driven roller 33.

The method illustrated in FIG. 11C is applicable to the case in which the transfer belt 31 is made of light transmissive materials. The belt information mark 31*b* (not illustrated) may be formed on either the outer surface or the inner surface of the transfer belt 31, and has a pattern including alternate white stripes, which are transmissive, and black stripes, which are not transmissive. The belt information mark 31*b* is detected by the belt information detection sensor 42, which is a transmission type sensor. Specifically, a light beam from a light emission part 42*a* of the belt information detection sensor 42 is incident on the white-black pattern of the belt information mark 31*b*, and passes through the transfer belt 31 with an amount of light corresponding to the local pattern at the incident spot. The transmitted light is received by a light reception part 42*b* of the belt information detection sensor 42, and the belt information is obtained from the electrical signals corresponding to the received light.

The optical pattern of the belt information mark 31*b* on the transfer belt 31 can be read with the belt information detection sensor 42 by any one of the methods illustrated in FIGS. 11A through 11C.

Figure 12A:
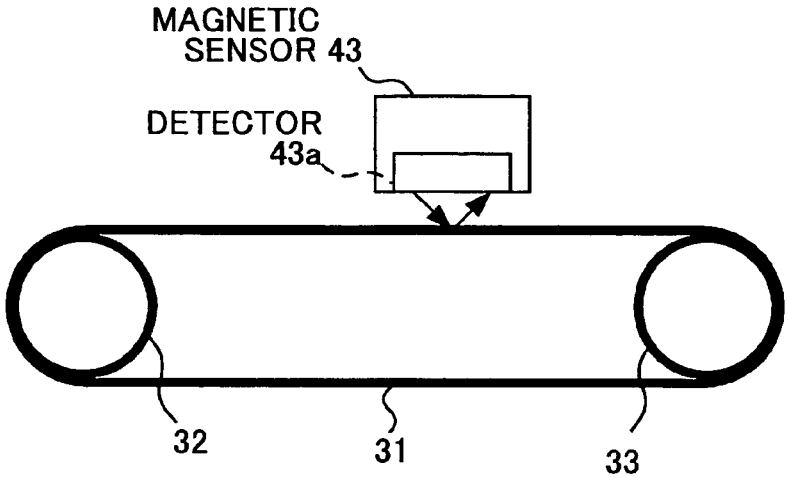
FIGS. 12A and 12B are schematic views showing other examples of methods for detecting the belt information mark 31*b* including an optical pattern.
Figure 12B:
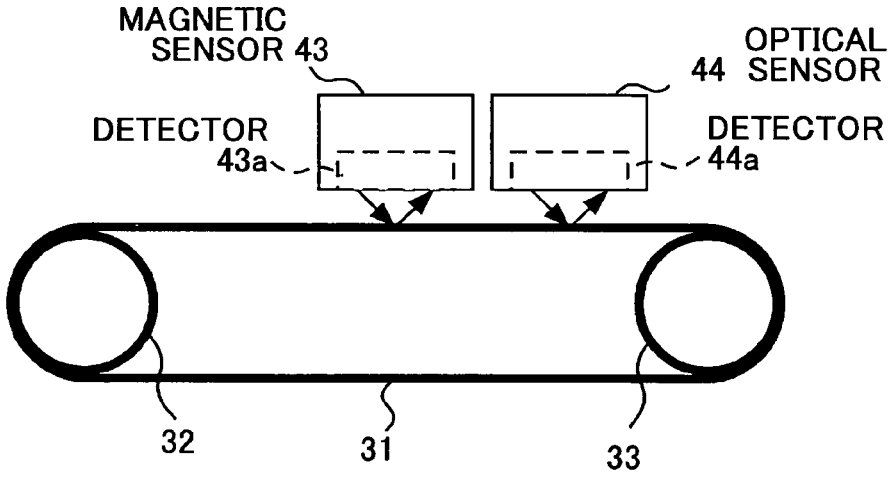

FIGS. 12A and 12B are schematic views showing other examples of methods for detecting the belt information mark 31*b* including an optical pattern with the belt information detection sensor 42.

In FIG. 12A, the belt information mark 31*b* (not illustrated) on the outer surface of the transfer belt 31 includes a magnetic pattern, and a magnetic sensor 43 is used as the belt information detection sensor 42.

The magnetic sensor 43 has a detection part 43*a* including a magnetic header, a hole element, and others. The detection part 43*a* is arranged at an appropriate position on the main body of the image forming apparatus opposite to the belt information mark 31*b* so that the detection part 43*a* is able to magnetically detect the belt information mark 31*b* on the transfer belt 31 to read the belt information represented by the pattern of the belt information mark 31*b*.

The belt information mark 31*b* including a magnetic pattern, for example, may be formed by recording thickness variation data of the transfer belt 31 in a tape-like member having magnetic characteristics, and pasting the member at the edge of the transfer belt 31 out of the image forming region of the transfer belt 31. Alternatively, the belt information mark 31*b* including a magnetic pattern may be formed by applying a magnetic material in a region near the edge of the transfer belt 31 out of the image forming region of the transfer belt 31, and directly recording the thickness variation data of the transfer belt 31 in this region directly by using the magnetic header.

In order that the HP mark 31*a* on the transfer belt 31 can be detected with the magnetic sensor 43, the HP mark 31*a* may be formed to possess magnetism. Thus, the magnetic sensor 43 functions as the HP mark detection sensor 41 and the belt information detection sensor 42 simultaneously.

As illustrated in FIG. 12B, both a magnetic sensor 43 and an optical sensor 44 may be provided on the main body of the image forming apparatus, and the HP mark 31*a* and the belt information mark 31*b* may be formed to have a magnetic pattern and an optical pattern, respectively, or vice versa. Thereby, the magnetic sensor 43 and the optical sensor 44 can be used as the HP mark detection sensor 41 and the belt information detection sensor 42, or vice versa.

In this case, it is easy to distinguish the HP mark 31*a* and the belt information mark 31*b*, because the HP mark 31*a* and the belt information mark 31*b* are detected by different methods.

Figure 13:
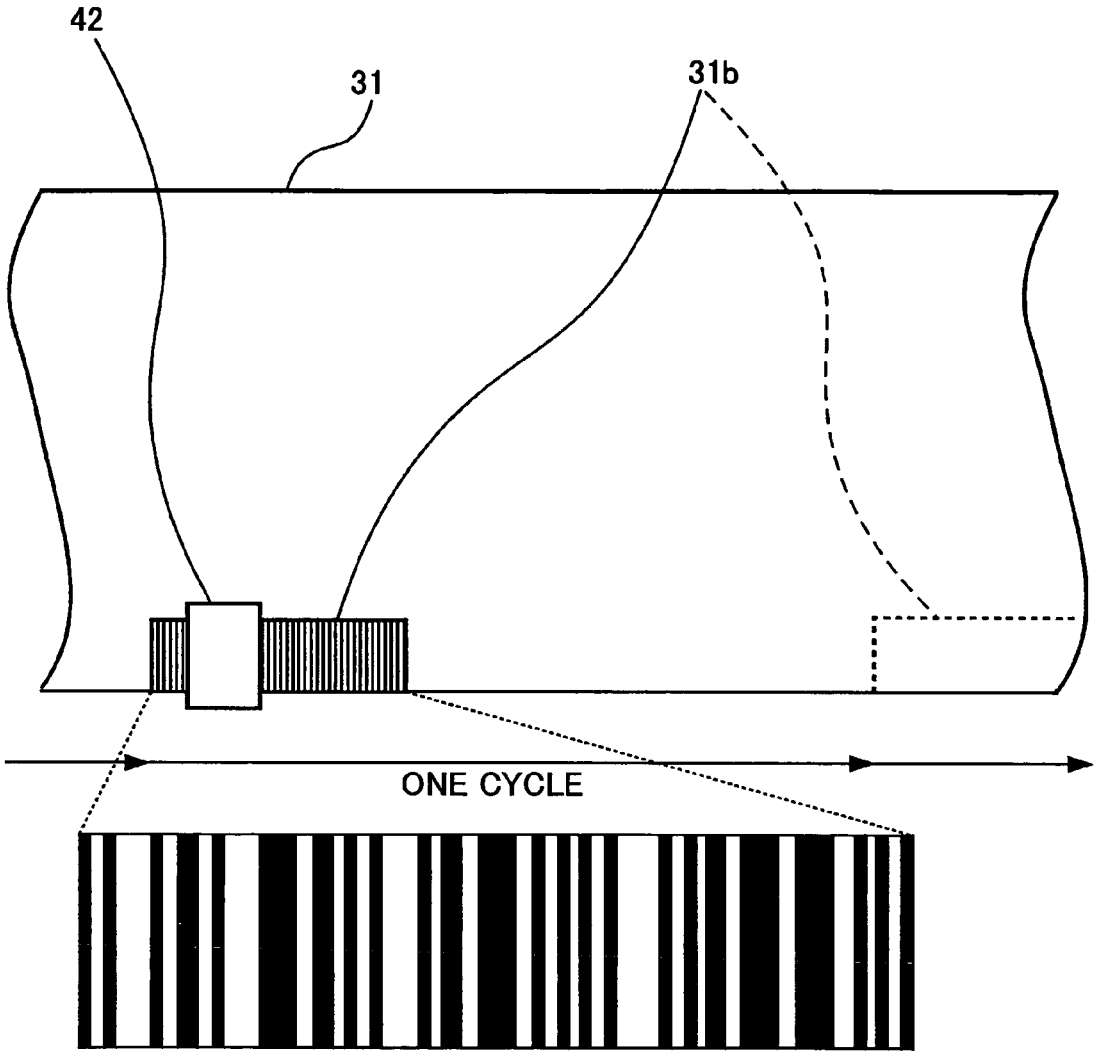
FIG. 13 is a schematic view of the transfer belt 31 including the belt information mark 31*b* that also functions as the HP position mark 31*a;*

FIG. 13 is a schematic view of the transfer belt 31 including the belt information mark 31*b* that also functions as the HP position mark 31*a*.

In FIG. 13, there is formed the belt information mark 31*b* but not the HP position mark 31*a* on the transfer belt 31, and the belt information mark 31*b* also functions as the HP position mark 31*a*.

The belt information detection sensor 42 detects the pattern of the belt information mark 31*b* while the transfer belt 31 moves in the longitudinal direction, and when the belt information detection sensor 42 finds the header section of the pattern, the header section is regarded as the position of the HP position mark 31*a*. With this position as a reference, the motor controller 7 controls the rotating speed of the driving roller 32 so that the moving speed of the transfer belt 31 in the longitudinal direction is constant regardless of the thickness variation of the transfer belt 31.

During the operation of controlling the rotating speed, the position of the transfer belt 31 in the longitudinal direction in contact with the outer circumference of the driving roller 32 is uniquely determined by a relation of the position of the belt information detection sensor 42, which also acts as the HP mark detection sensor 41, and the position of the driving roller 32. For this reason, the precision of the rotating speed control is not adversely affected even though the belt information mark 31*b* acts as the HP position mark 31*a* at the same time.

Figure 14:
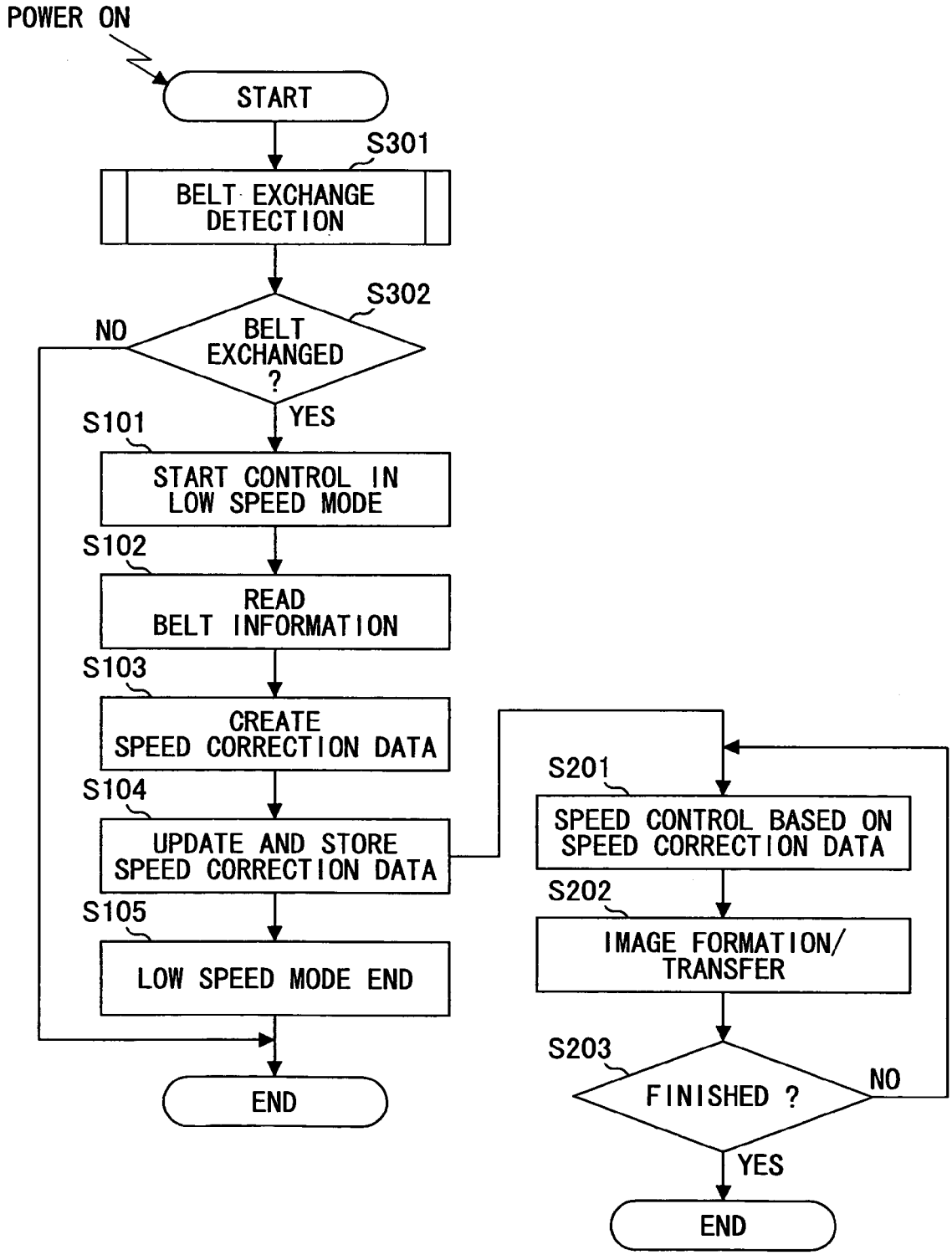
FIG. 14 is a flow chart showing another example of the operation of updating the rotational speed correction data illustrated in FIG. 9.

FIG. 14 is a flow chart showing another example of the operation of updating the rotational speed correction data illustrated in FIG. 9.

The procedure in FIG. 14 includes, in addition to steps illustrated in FIG. 9, a step S301 for detecting whether the transfer belt is exchanged, and a step S302 for making judgment. The other steps are the same as those in FIG. 9, therefore, the same reference characters are used for them, and the duplicate descriptions are omitted.

After the power of the color image forming apparatus is turned on, in step S301, operations are performed to determine whether or not the present power-ON is the first time of power-ON after exchange of the transfer belt 31 (referred to as "belt exchange detection operation" below).

In step S302, if it is determined in step S301 that the belt is exchanged, the routine proceeds to step S101 and the subsequent steps.

If it is determined in step S301 that the belt is not exchanged, the routine is finished.

Therefore, updating of the rotational speed correction data is performed when the transfer belt 31 is exchanged and an updating operation is required. Accordingly, there are no duplicate and useless updating operations. Moreover, there is no useless driving of the transfer belt 31, and this accordingly extends the service life of the transfer belt 31.

Figure 15:
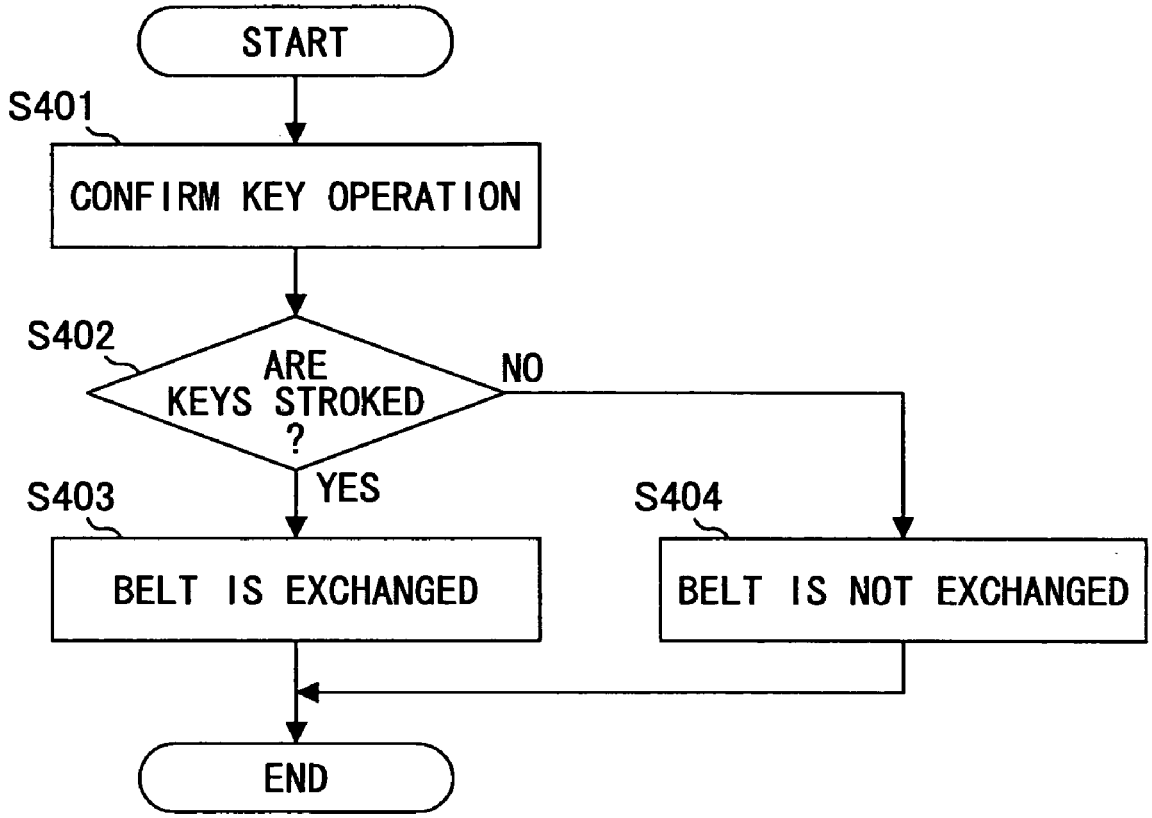
FIG. 15 is a flow chart showing an example of the belt exchange detection operation illustrated in FIG. 14.

FIG. 15 is a flow chart showing an example of the belt exchange detection operation illustrated in FIG. 14.

It is assumed that among the various keys of the operational panel 6, some are assigned for operation of belt exchange. For example, the operation of continuously pressing key A and key B simultaneously, may be defined to indicate the state of belt exchange.

In step S401, Key operation is confirmed.

In step S402, if it is determined that the special keys are operated, it indicates that the belt is exchanged, and the routine proceeds to step S403.

If it is determined that the special keys are not operated, it indicates that the belt is not exchanged, and the routine proceeds to step S404.

In the above description, although the state of belt exchange is indicated by key operations, it is not necessary to manually input the thickness variation data, because the belt information is automatically acquired by detecting and reading the belt information mark 31*b* on the transfer belt 31.

There are other methods for detecting whether or not the belt is exchanged or not.

Figure 16A:
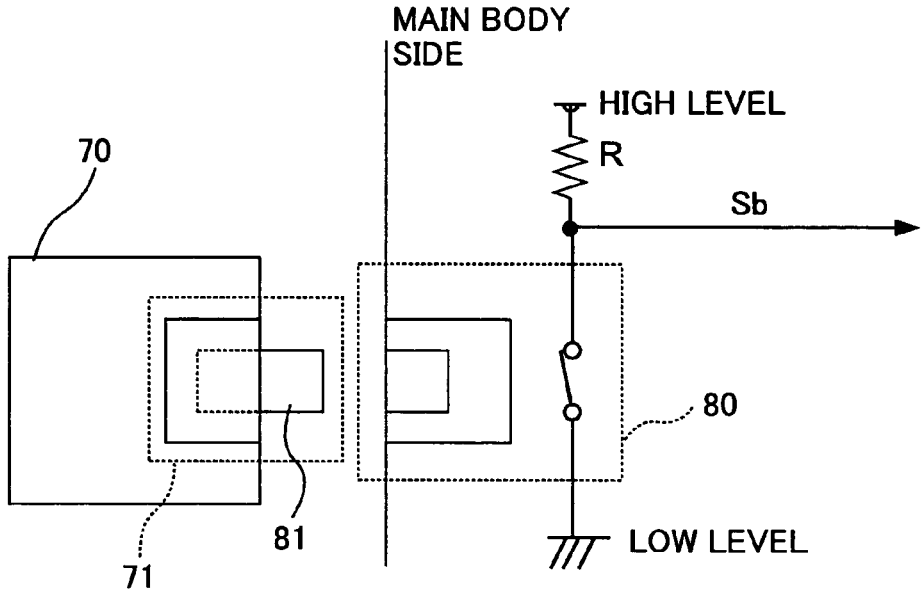
FIGS. 16A and 16B are schematic views showing an example of a configuration for performing the belt exchange detection.
Figure 16B:
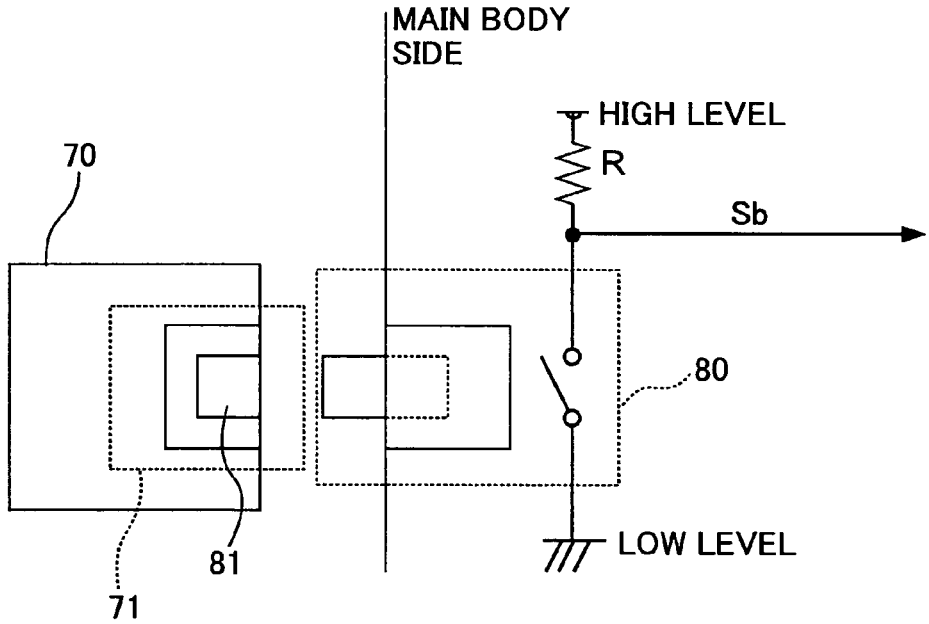

FIGS. 16A and 16B are schematic views showing an example of a configuration for performing the belt exchange detection.

As illustrated in FIGS. 16A and 16B, the transfer belt 31 (not illustrated) is in a belt unit 70, and a new belt detection unit 71 is provided on the side of the belt unit 70.

The new belt detection unit 71 is initially projecting and has a projecting portion 81 (as illustrated in FIG. 16A, referred to as "projecting state" below). After the belt unit 70 is set into the main body of the image forming apparatus, and the transfer belt 31 rotates for a sufficient large number of cycles, the projecting portion 81 disappears and the new belt detection unit 71 is no longer projecting (as illustrated in FIG. 16B, referred to as "planar state", below).

On the side of the main body, a new belt detection switch 80 is provided. The new belt detection switch 80 is set ON (as illustrated in FIG. 16A) when the new belt detection unit 71 is in the projecting state, and is set OFF (as illustrated in FIG. 16B) when the new belt detection unit 71 is in the planar state. A belt exchange detection signal Sb is extracted from the connection point between the switch 80 and a resistance R, and is input to the I/O unit 8 (FIG. 3). When the belt exchange detection signal Sb is at a high level, it indicates that the belt unit 70 is in normal use. When the belt exchange detection signal Sb is at a low level, it indicates that the belt is newly exchanged.

The new belt detection unit 71 may be formed from soft materials so that the projecting portion 81 of the new belt detection unit 71 is removed gradually by rotation wear when the transfer belt 31 rotates for a sufficient large number of cycles. Alternatively, the new belt detection unit 71 may be formed from brittle materials so that the projecting portion 81 of the new belt detection unit 71 drops when the transfer belt 31 rotates for a sufficient large number of cycles.

The new belt detection unit 71 may have a structure so that the new belt detection unit 71 is pushed by the main body to slide, and thereby being set to the planar state.

Figure 17A:
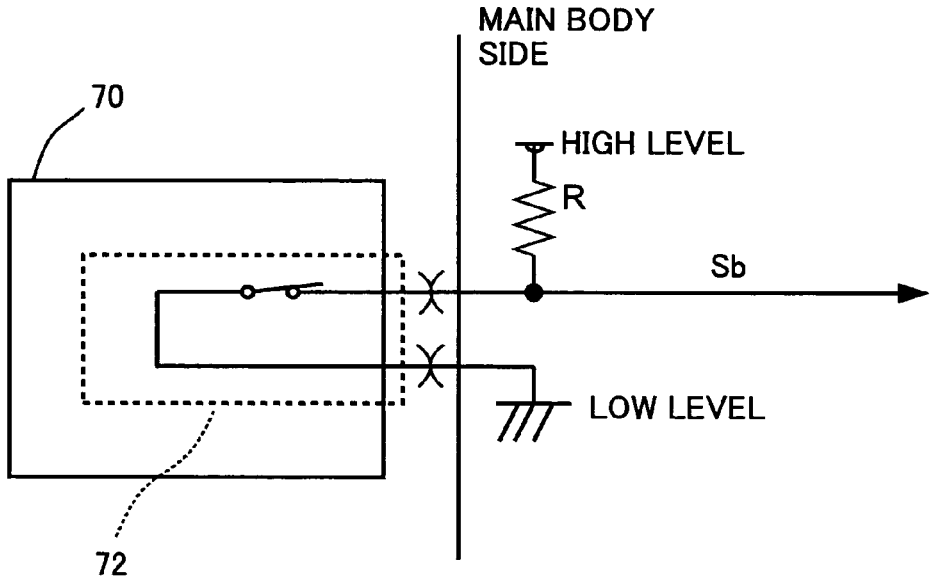
FIGS. 17A and 17B are schematic views showing another example of a configuration for performing the belt exchange detection.
Figure 17B:
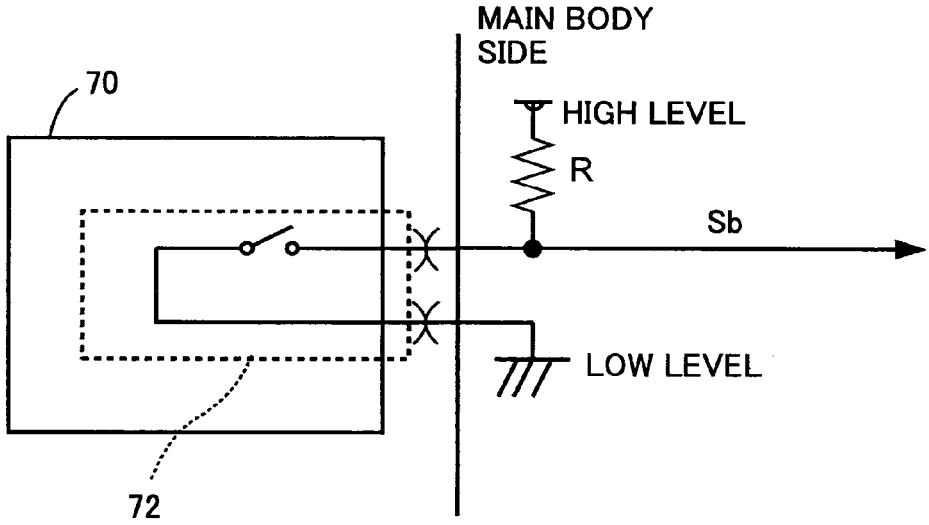

FIGS. 17A and 17B are schematic views showing another example of a configuration for performing the belt exchange detection.

As illustrated in FIGS. 17A and 17B, the transfer belt 31 (not illustrated) is in the belt unit 70, and a new belt detection circuit 72 is provided on the side of the belt unit 70. The new belt detection circuit 72 is configured in such a way that electric connection therein is broken after the transfer belt 31 rotates for a sufficient large number of cycles.

On the side of the main body, a resistance R is electrically connected with the new belt detection circuit 72, and a belt exchange detection signal Sb is extracted from the connection point between the new belt detection circuit 72 and the resistance R, and is input to the I/O unit 8.

When the belt exchange detection signal Sb is at the high level, it indicates that the belt unit 70 is in normal use, and when the belt exchange detection signal Sb is at a low level, it indicates that the belt is newly exchanged.

The new belt detection circuit 72 may be formed from a brittle line that is broken due to mechanical fatigue when the transfer belt 31 rotates for a sufficient large number of cycles. Alternatively, the new belt detection circuit 72 may be formed from a fuse that is meltdown by a large current from the main body of the image forming apparatus when the transfer belt 31 rotates for a sufficient large number of cycles. Or the new belt detection circuit 72 may be configured so that it is cut down by a cutting mechanism on the main body of the image forming apparatus when the transfer belt 31 rotates for a sufficient large number of cycles.

Figure 18:
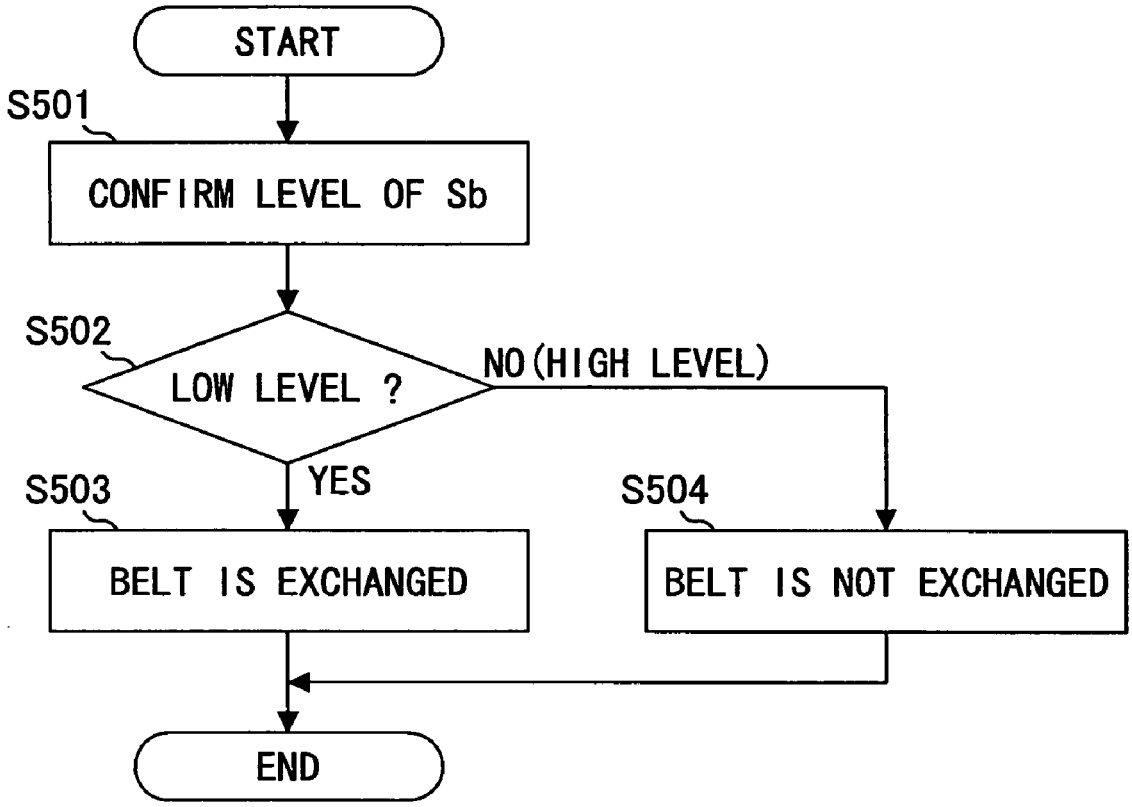
FIG. 18 is a flow chart showing another example of the belt exchange detection operation by using the belt exchange detection signal Sb.

FIG. 18 is a flow chart showing another example of the belt exchange detection operation by using the belt exchange detection signal Sb described above.

In step S501, the level of the belt exchange detection signal Sb is confirmed.

In step S502, if the belt exchange detection signal Sb is at the low level, it indicates that the belt is exchanged, and the routine proceeds to step S503.

If the belt exchange detection signal Sb is at the high level, it indicates that the belt is not exchanged, and the routine proceeds to step S504.

In this way, the operation of belt exchange detection is performed automatically, and the user does not need be conscious of the necessity of rotating speed control of the motor 7*b* in accordance with the thickness variation of the transfer belt 31. The user just needs exchange the belt unit 70, and thereby, operation of updating the rotational speed correction data can be performed, and the number of times of the updating operation is reduced to a minimum necessary value.

While the present invention is described with reference to specific embodiments chosen for purpose of illustration, it should be apparent that the invention is not limited to these embodiments, but numerous modifications could be made thereto by those skilled in the art without departing from the basic concept and scope of the invention.

Figure 2:
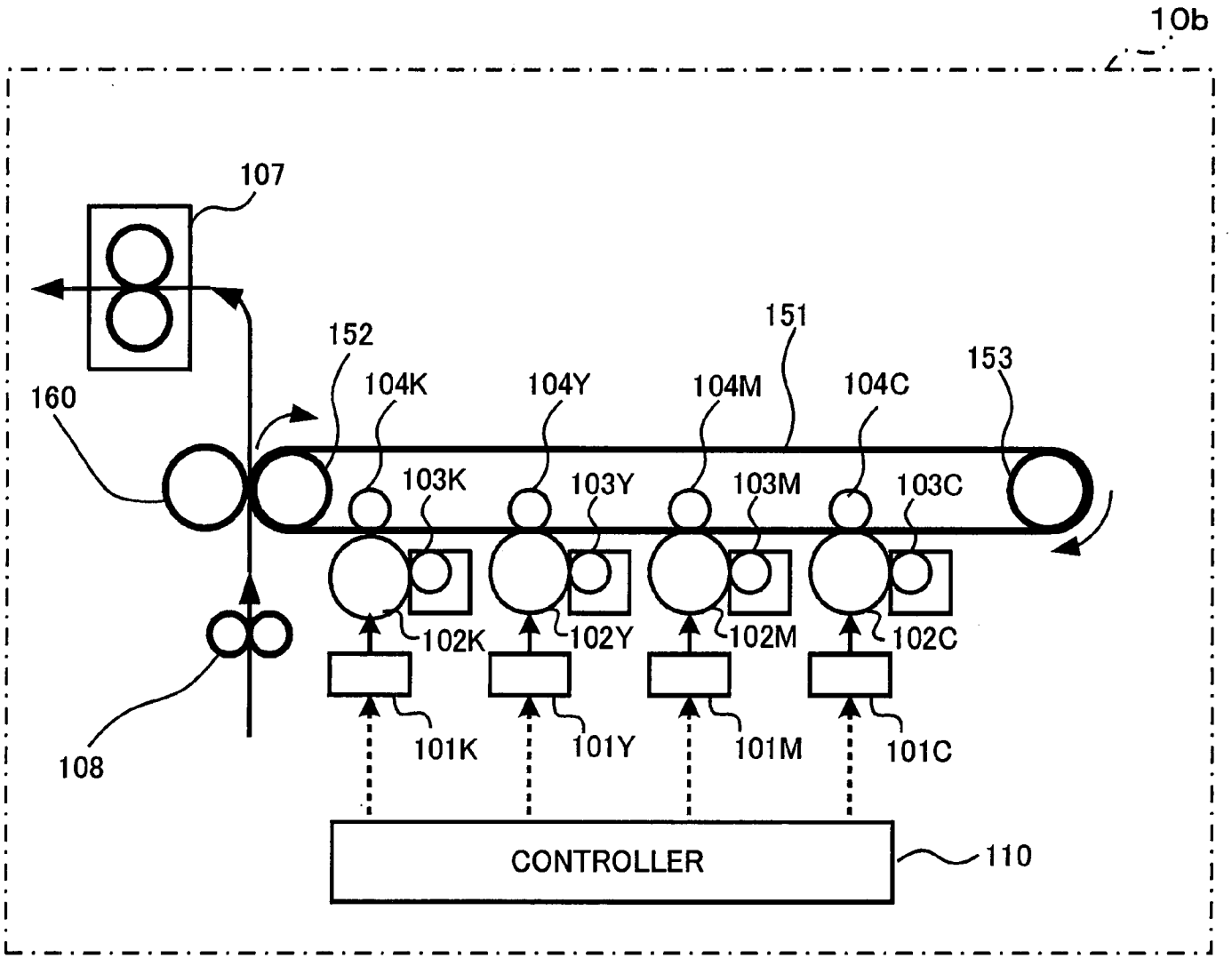
FIG. 2 is a schematic view showing a configuration of an indirect-transfer image forming apparatus 10*b;*

For example, in the above, it is described that the present invention may be applied to speed control of a transfer belt in a direct-transfer image forming apparatus, but the present invention is not limited to this. The present invention can also be applied to speed control of a transfer belt in an indirect-transfer image forming apparatus as illustrated in FIG. 2.

In addition, the method of transfer belt speed control of the present invention can be applied to various apparatuses which use transfer belts and moving speeds of the transfer belts change due to different manners of thickness variations of the transfer belts.

According to an aspect of the present invention, because the belt information is read from the belt information mark on the transfer belt, the rotational speed correction data is automatically updated based on the obtained belt information, and with the updated rotational speed correction data, the moving speed of the transfer belt in the longitudinal direction may be controlled to be constant. Therefore, it is possible to automatically set data of variation of thickness of a transfer belt newly installed into an image forming apparatus, and a cumbersome manual setting operation is not necessary. As a result, it is possible to constantly output images of high quality without color deviation.

In addition, because the pattern of the belt information mark may be optically readable, and the pattern may be read by optical methods, it is possible to simplify the structure of the detection circuit, and reduce cost of the detection circuit. Further, because for detection of the pattern of the belt information mark, use is made of an optical sensor that is originally provided in the image forming apparatus for determining the HP position mark, that is, the reference for determining a position on the transfer belt in the longitudinal direction, additional devices are not necessary. Accordingly, it is possible to reduce cost of the detection circuit.

In addition, because the belt information may be recorded in a magnetically recordable material, and belt information can be magnetically recorded, the belt information can be easily recorded in the magnetic material, compared with fabricating a bar-code shape optical pattern for being optically read. Further, when optically reading the belt information, if toner is scattered on the surface of the optical sensor or the transfer belt, the detection accuracy may be degraded due to the surface contamination. However, if the belt information is read magnetically, influence of the surface contamination is little, and therefore, compared with the optical method, a high detection accuracy can be obtained.

A HP mark on the transfer belt for indicating the home position of the belt is preferable for detecting a reference position in speed control of the transfer belt. By using the position of the belt information mark as the home position, it is not necessary to prepare a separate home position mark, and it is not necessary to perform detection of the home position mark and detection of the belt information mark separately. Therefore, detection and processing of the detected information become easy.

If detection of the belt information is performed prior to speed control of the transfer belt based on the detected belt information, it may take some time for detecting the belt information and waiting for the belt information to be driven stably, and thereby, one has to wait for a relatively long time before printing is started. Further, because the transfer belt is rotated for more cycles compared with the case in which the pattern of the belt information mark is not detected, and the speed control is not performed, the service life of the belt may become short. To avoid this problem, according to an aspect of the present invention, detection of the belt information mark is performed only once when the belt is exchanged, accordingly, there is little influence on speed of usual printing operation and on the service life of the transfer belt. Further, because there are little contaminations on the transfer belt after the belt is newly exchanged, detection accuracy can be improved by detecting the belt information mark after when the belt is newly exchanged.

In addition, in a color image forming apparatus having a high printing speed, when detecting the pattern of the belt information mark, because the time for the pattern on the transfer belt to pass above the sensor is short, sometimes the sensor may fail to detect the belt information mark. In order to maintain detection accuracy, it is necessary to use a sensor capable of fast response. For these reasons, the detection circuit becomes expensive. To solve this problem, when reading the belt information, the moving speed of the transfer belt is set lower than its usual speed during formation of the color image by superposing the monochromatic color images. Due to this, the time for the pattern on the transfer belt to pass above the sensor becomes longer, and accordingly, the belt information mark can be more reliably detected, and thereby, detection accuracy of the belt information mark is improved. Therefore, even if a slow-response sensor is used, the belt information mark can be reliably detected, and detection accuracy can be maintained, furthermore, because a high speed electric circuit is not necessary, it is possible to reduce cost of the belt information detection system.

Because it is sufficient to just lower the speed of the transfer belt when detecting the belt information for speed control, this method can be used in the color image forming apparatus having a high printing speed without changes of the configurations thereof. Further, by detecting the belt information when the belt is exchanged, even the speed of the transfer belt is lowered when detecting the belt information, there is no adverse influence on the printing operation at the usual speed.

This patent application is based on Japanese Priority Patent Application No. 2003-178988 filed on Jun. 24, 2003, the entire contents of which are hereby incorporated by reference.

What is claimed is:

1. An image forming apparatus comprising:

a plurality of photo conductors arranged in series with a plurality of monochromatic color images formed thereon, respectively, said monochromatic color images being color components of a target color image;

a transfer belt that is wound on a rotating driving roller and moves along a longitudinal direction thereof, the monochromatic color images on the photo conductors being transferred to said transfer belt sequentially and superposed on the transfer belt to form the target color image;

a rotational speed control unit configured to control a rotating speed of the driving roller while making reference to rotational speed correction data so that a moving speed of the transfer belt in the longitudinal direction is maintained to be constant regardless of variation of thickness of the transfer belt in the longitudinal direction, said rotational speed correction data being created based on a relationship between a position on the transfer belt in the longitudinal direction and a thickness of the transfer bell at the position, the transfer belt including a belt information mark recorded with information used for creating the rotational speed correction data, and the rotational speed control unit including a storage unit configured to store the rotational speed correction data, a belt information reading unit configured to read the belt information mark to obtain the information used for creating the rotational speed correction data, and a correction data updating unit configured to update and store the rotational speed correction data based on the information read from the belt information mark; and a speed limitation unit configured to control the moving speed of the transfer belt when the belt information mark is read so that the moving speed of the transfer belt is lower than a usual moving speed of the transfer belt when forming the target color image.

2. The image forming apparatus as claimed in claim 1, wherein the belt information mark includes an optically readable pattern; and the belt information reading unit optically reads the belt information mark and acquires the information for creating the rotational speed correction data.

3. The image forming apparatus as claimed in claim 1, wherein the belt information mark includes a magnetically readable pattern; and the belt information reading unit magnetically reads the belt information mark and acquires the information for creating the rotational speed correction data.

4. The image forming apparatus as claimed in claim 1, wherein the position of the belt information mark on the transfer belt is also used as a reference position for determining the position on the transfer belt in the longitudinal direction.

5. The image forming apparatus as claimed in claim 1, further comprising a belt exchange detection unit configured to detect whether the transfer belt is newly exchanged, wherein the correction data updating unit updates and stores the rotational speed correction data based on the information read from the belt information mark only when the belt exchange detection unit determines that the transfer belt is newly exchanged.

6. The image forming apparatus as claimed in claim 1, wherein a recording sheet is closely attached onto the transfer belt; and the monochromatic color images on the photo conductors are directly transferred onto the recording sheet sequentially and superposed on the recording sheet to form the target color image.

7. The image forming apparatus as claimed in claim 1, wherein the monochromatic color images on the photo conductors are transferred sequentially and superposed onto the transfer belt to form the target color image; and the superposed target color image is transferred again onto a recording sheet.

8. An image forming apparatus comprising:

a plurality of photo conductors arranged in series with a plurality of monochromatic color images formed thereon, respectively, said monochromatic color images being color components of a target color image;

a transfer belt wound on a rotating driving roller and configured to move along a longitudinal direction thereof, the monochromatic color images on the photo conductors being transferred to said transfer belt sequentially and superposed on the transfer belt to form the target color image;

a rotational speed control unit configured to control a rotating speed of the driving roller while making reference to rotational speed correction data so that a moving speed of the transfer belt in the longitudinal direction is maintained to be constant regardless of variation of thickness of the transfer belt in the longitudinal direction, said rotational speed correction data being created based on a relationship between a position on the transfer belt in the longitudinal direction and a thickness of the transfer belt at the position, the transfer belt including a belt information mark recorded with information used for creating the rotational speed correction data, and the rotational speed control unit including a belt information reading unit configured to rend the belt information mark to obtain the information used for creating the rotational speed correction data; and a speed limitation unit configured to control the moving speed of the transfer belt when the belt information mark is read so that the moving speed of the transfer belt is lower than a usual moving speed of the transfer belt when forming the target color image.

9. The image forming apparatus us claimed in claim 8, wherein the belt information mark includes an optically readable pattern; and the belt information reading unit optically reads the belt information mark and acquires the information for creating the rotational speed correction data.

10. The image forming apparatus as claimed in claim 8, wherein the belt information mark includes a magnetically readable pattern; and the belt information reading unit magnetically reads the belt information mark and acquires the information for creating the rotational speed correction data.

11. The image forming apparatus as claimed in claim 8, wherein the position of the belt information mark on the transfer belt is also used as a reference position for determining the position on the transfer belt in the longitudinal direction.

12. The image forming apparatus as claimed in claim 8, further comprising a belt exchange detection unit configured to detect whether the transfer belt is newly exchanged.

13. The image forming apparatus as claimed in claim 8, wherein a recording sheet is closely attached onto the transfer belt; and the monochromatic color images on the photo conductors are directly transferred onto the recording sheet sequentially and superposed on the recording sheet to form the target color image.

14. The image forming apparatus as claimed in claim 8, wherein the monochromatic color images on the photo conductors are transferred sequentially and superposed onto the transfer belt to form the target color image; and the superposed target color image is transferred again onto a recording sheet.

* * * * *